US010830000B2

(12) United States Patent
Graham et al.

(10) Patent No.: US 10,830,000 B2
(45) Date of Patent: Nov. 10, 2020

(54) EXTRUDATE-PRODUCING RIDGED CUTTING ELEMENT

(71) Applicant: National Oilwell Varco, L.P., Houston, TX (US)

(72) Inventors: Ryan Graham, The Woodlands, TX (US); Reza Rahmani, Spring, TX (US); Brad Ivie, Conroe, TX (US); Olivia Pacheco, Katy, TX (US)

(73) Assignee: National Oilwell Varco, L.P., Houston, TX (US)

( * ) Notice: Subject to any disclaimer, the term of this patent is extended or adjusted under 35 U.S.C. 154(b) by 263 days.

(21) Appl. No.: 15/962,929

(22) Filed: Apr. 25, 2018

(65) Prior Publication Data

US 2019/0330928 A1 Oct. 31, 2019

(51) Int. Cl.
*E21B 10/567* (2006.01)
*E21B 10/573* (2006.01)

(52) U.S. Cl.
CPC ..... *E21B 10/5676* (2013.01); *E21B 10/573* (2013.01); *E21B 10/567* (2013.01)

(58) Field of Classification Search
CPC ..... E21B 10/5676; E21B 10/573; E21B 2010/561; E21B 10/42; E21B 10/46; E21B 10/54; E21B 10/55; E21B 10/56; E21B 10/5673
See application file for complete search history.

(56) References Cited

U.S. PATENT DOCUMENTS 4,928,777 A * 5/1990 Shirley-Fisher .... E21B 10/5673 175/430
5,819,861 A * 10/1998 Scott ..... E21B 10/006 175/371
6,045,440 A * 4/2000 Johnson ..... E21B 10/5673 451/540

(Continued)

FOREIGN PATENT DOCUMENTS

WO WO-2012012774 A2 * 1/2012 ..... E21B 10/5735
WO WO-2012056196 A2 * 5/2012 ..... B24D 18/0009

(Continued)

OTHER PUBLICATIONS

International Patent Application No. PCT/US2019/024214 International Search Report and Written Opinion dated Jun. 25, 2019 (16 pages).

(Continued)

*Primary Examiner* — Daniel P Stephenson
(74) *Attorney, Agent, or Firm* — Conley Rose, P.C.

(57) ABSTRACT

A cutting element for a drill bit includes a PCD cutting face having a ridge that extends away from the periphery towards the center of the cutting face, terminating in a curved, central most ridge end. The cutting face further includes a surrounding surface consisting of the entire cutting face except for the ridge. The surrounding surface is free of flats and includes two side regions and a ramp region therebetween. The surrounding surface is continuously curved along a curved path that extends from the first side region to the ramp region (Continued)

to the other side region. In profile views, the surrounding surface may be linear moving from the top surface of the ridge to the periphery at every location along the curved path.

26 Claims, 19 Drawing Sheets

(56) References Cited

U.S. PATENT DOCUMENTS 6,059,054 A 5/2000 Portwood et al.
7,681,673 B2 * 3/2010 Kolachalam ..... E21B 10/16 175/430
8,037,951 B2 * 10/2011 Shen ..... E21B 10/5735 175/426
8,721,752 B2 * 5/2014 Fuller ..... C22C 26/00 175/420.2
8,783,387 B2 * 7/2014 Durairajan ..... E21B 10/5673 175/426
8,875,812 B2 * 11/2014 Setlur ..... B22F 7/08 175/379
8,910,730 B2 * 12/2014 Griffin ..... B22F 7/06 175/426
8,945,720 B2 * 2/2015 Sreshta ..... B22F 1/025 175/425
8,997,900 B2 * 4/2015 Sue ..... E21B 10/567 175/420.2
9,074,435 B2 * 7/2015 Scott ..... E21B 10/42
9,441,422 B2 * 9/2016 DiSantis ..... E21B 10/5673
10,240,399 B2 * 3/2019 Rahmani ..... E21B 10/5676
10,280,688 B2 * 5/2019 Dunbar ..... E21B 10/5673
2010/0300766 A1 12/2010 Fan et al.
2014/0060934 A1 3/2014 DiSantis
2017/0356250 A1 12/2017 Scott et al.
2019/0330928 A1 * 10/2019 Graham ..... E21B 10/55

FOREIGN PATENT DOCUMENTS

WO WO-2014036283 A1 * 3/2014 ..... E21B 7/00
WO 2015/161010 A2 10/2015
WO 2015/161010 A3 10/2015
WO WO-2015161010 A2 * 10/2015 ..... E21B 10/5676

OTHER PUBLICATIONS

GCC Patent Application No. GC 2019-37365 Examination Report dated Apr. 29, 2020 (4 pages).

* cited by examiner

EXTRUDATE-PRODUCING RIDGED CUTTING ELEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to drilling equipment. More specifically, the disclosure relates to drill bits and cutting elements used for drilling through earthen formations to form wellbores.

A number of operations are performed to locate and recover valuable oil and gas from the subterranean formations in which they reside. Oil rigs are positioned at well sites and downhole tools, such as drilling tools, are deployed into the ground to reach the subsurface fluid reservoirs. The drilling tool may include a drill string having a drill bit that is advanced into the earth to form a wellbore. The drill bit is rotated by rotating the drill string from the surface and/or by a downhole motor that may be powered by drilling fluid ("mud") that is pumped through the drilling tool.

In oil and gas drilling, the cost of drilling a borehole is very high, and is proportional to the length of time it takes to drill to the desired depth and location. Drilling time, in turn, is greatly dependent on the number of times a drill bit must be changed before the targeted formation is reached. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is always desirable to employ drill bits which will drill faster and longer. The length of time that a drill bit may be employed before it must be changed depends upon its rate of penetration ("ROP"), as well as its durability. The design of the bit's cutting elements greatly impacts bit durability and ROP, and thus is critical to the success of a particular bit design.

The standard in many of today's drilling applications is a drill bit that employs cutting elements having a polycrystalline diamond ("PCD") layer as the cutting face. Examples of such a drill bit and/or cutting element are provided in U.S. Pat. No. 9,441,422 entitled Cutting Element for a Rock Drill Bit, the entire contents of which are hereby incorporated by reference herein. Other examples of drill bits and/or cutting elements are provided in WO2012/056196, WO2012/012774, and U.S. Pat. Nos. 8,875,812, 8,945,720, 8,721,752, 8,997,900, and 8,910,730, the entire contents of which are hereby incorporated by reference herein.

PCD designs are known that include various diamond faces that adjoin one another and that together, make up the cutting face of the cutter. Some have proven effective; however, enhanced durability remains desired, and substantial manufacturing challenges exist for such cutting elements. Thus, there remains a need for a long lasting PCD cutting element that provides good ROP, is durable, and that can be reliably manufactured at reasonable cost.

SUMMARY OF THE DISCLOSURE

These and other needs in the art are addressed by the exemplary embodiments of drill bits and cutting elements disclosed herein. In a first such embodiment, a cutting element for a drill bit comprises: a substrate portion, a central axis extending through the substrate portion, and a PCD layer forming an end of the cutting element, the PCD layer comprising a cutting face bounded by a periphery. The cutting face comprises: an elongate ridge having an upper surface defining the uppermost height of the cutting element, the ridge having a first ridge end and extending from the first ridge end in a direction towards the center of the cutting face and terminating in a second ridge end that is curved; and a surrounding surface consisting of the entire cutting face except for the ridge, the surrounding surface being continuously curved along a curved path extending at least partially about the curved second ridge end.

In some embodiments, the cutting element further comprises a leading edge at the intersection of the cutting face and the periphery, and wherein the first ridge end is offset a distance from the leading edge. The cutting face may further comprise a pair of linear edges at the periphery, the leading edge being curved and positioned between the pair of linear edges. In some embodiments, the upper surface of the ridge is planar, and in other embodiments, the upper surface of the ridge is convex.

In some embodiments, the cutting element further comprises a leading edge at the intersection of the cutting face with the periphery, and wherein the ridge extends from the second ridge end to the leading edge and the length of the ridge is less than 40% of the diameter of the cutting element. The length of the ridge may be less than 10% of the diameter of the cutting element and, in some embodiments, the width of the ridge may be less than 10% of the diameter of the cutting element.

In some embodiments, the surrounding surface, in profile view, is linear from the ridge to the periphery at every location along the curved path, and in other embodiments, the surrounding surface, in profile view, is curved from the ridge to the periphery at every location along the curved path.

In some embodiments, the surrounding surface comprises: a first side region on one side of the ridge and extending from the periphery to a first side of the ridge; a second side region on the opposite side of the ridge from the first side region and extending from the periphery to a second side of the ridge that is opposite from the first side of the ridge; a ramp region extending from the periphery to the second ridge end and extending between the first and second side regions; wherein, in a profile view, a plane that encompasses the planar surface of the ridge forms a slant angle with the first side region and a ramp angle with the ramp region; and wherein the slant angle is different than the ramp angle, and wherein the thickness of the PCD layer varies along the periphery.

The slant angle may be greater than the ramp angle and the thickness of the PCD layer may be thicker in the ramp region than in the first side region. In some embodiments, the slant angle is between 2 and 20 degrees and the slant angle is greater than the ramp angle, and the thickness of the PCD layer varies along the periphery in some embodiments.

In some embodiments, the periphery includes a leading point and a trailing point opposite the leading point, wherein the thickness of the PCD layer at the trailing point is greater than the thickness of the PCD layer at a point 90 degrees from the trailing point. The width of the ridge may be non-uniform along it length.

In some embodiments, the surrounding surface comprises: a first side region on one side of the ridge and extending from the periphery to a first side of the ridge; a second side region on the opposite side of the ridge from the first side region and extending from the periphery to a second side of the ridge that is opposite from the first side of the ridge; a ramp region extending from the periphery to the second ridge end and extending between the first and second side regions; and wherein, in a profile view, each side region is curved having a radius of curvature R1 and the ramp region is curved having a radius of curvature R2 and wherein R1 is the same as R2.

Also disclosed is a cutting element for a drill bit comprising: a generally cylindrically shaped substrate formed about a central axis and having a diameter D and a PCD layer attached to the substrate, the PCD layer comprising a cutting face with center C that is bounded by a periphery. The cutting face consists of an elongate ridge and a continuously curved surrounding surface; wherein the ridge includes a planar upper surface extending radially from a first ridge end that is adjacent to the periphery to a second ridge end disposed at a location that is offset a radial distance from the center C; and wherein the surrounding surface comprises a pair of side regions separated by the ramp region disposed between the side regions, wherein the pair of side regions, the ramp region and the intersection between the ramp region and each side region are all continuously curved; and wherein the highest point on the cutting face lies within the planar upper surface of the ridge.

In some embodiments, in a profile view, a plane that encompasses the planar surface of the ridge forms a slant angle with each side region and forms a ramp angle with the ramp region, and wherein the slant angle is different than the ramp angle.

In some embodiments, in a profile view, a plane that encompasses the planar surface of the ridge forms a ramp angle with the ramp region that is between 2 and 10 degrees.

In some embodiments, the end of the planar upper surface of the ridge that is closest to the central axis is curved.

Also disclosed is a drill bit that is advanceable into a subterranean formation to form a wellbore, where the drill bit comprises: a bit body; and at least one cutting element mounted in the bit body; wherein the cutting element includes a PCD cutting face consisting of an elongate ridge and a continuously curved surrounding surface. The surrounding surface comprises a pair of side regions separated by the ramp region disposed between the side regions, wherein the pair of side regions, the ramp region and the intersection between the ramp region and each side region are all continuously curved; and wherein the highest point on the cutting face lies within the upper surface of the ridge.

These and various other features and characteristics of above-mentioned cutting elements and drill bits are described in more detail below, and will be readily understood and appreciated upon reading the following detailed description of the exemplary embodiments, and by referring to the accompanying drawings.

BRIEF DESCRIPTION OF THE DRAWINGS

So that the above-recited features can be best understood and appreciated, a more particular description than what is summarized above may be had by reference to the exemplary embodiments thereof that are illustrated in the appended drawings. Importantly, the examples illustrated are not to be considered as limiting the scope of this disclosure. The Figures are not necessarily to scale and certain features and certain views of the Figures may be shown exaggerated in scale or in schematic form in the interest of clarity and conciseness.

DETAILED DESCRIPTION OF DISCLOSED EXEMPLARY EMBODIMENTS

This disclosure is directed to a cutting element (or cutter or cutting insert) for a cutting or drilling tool, such as a bit used to drill wellbores. The cutting element includes a cutting face (or "working surface") having a ridge that defines the uppermost surface of the cutting element, and also having a nonplanar and continuously curved surface surrounding the ridge. The surrounding surface includes two side regions that are separated on the cutting face by the ridge, and includes a fluid-directing ramp surface trailing behind the ridge and disposed between the two side regions. A chamfer is formed about the cutting face, and the ridge extends from the chamfer at a periphery of the face or, in some cases, from near the periphery toward the center of the cutting face. The ridge is provided to concentrate force against the earthen formation to enhance cutting, and the shape of the cutting face designed to draw the extrudates of formation material down the pair of side regions. The ramp region, extending between the two side regions, directs drilling fluid toward the leading edge of the cutting element during drilling. The ridged cutting elements described herein are intended to provide good cutting and cleaning efficiency (and thus good ROP) and to exhibit enhanced durability (e.g. provide good ROP for substantial periods of time). Further, the cutting elements described herein offer manufacturing advantages as compared to certain known cutting element designs, such as those having multiple planar and adjoining PCD surfaces on a single cutting face.

Figure 1:
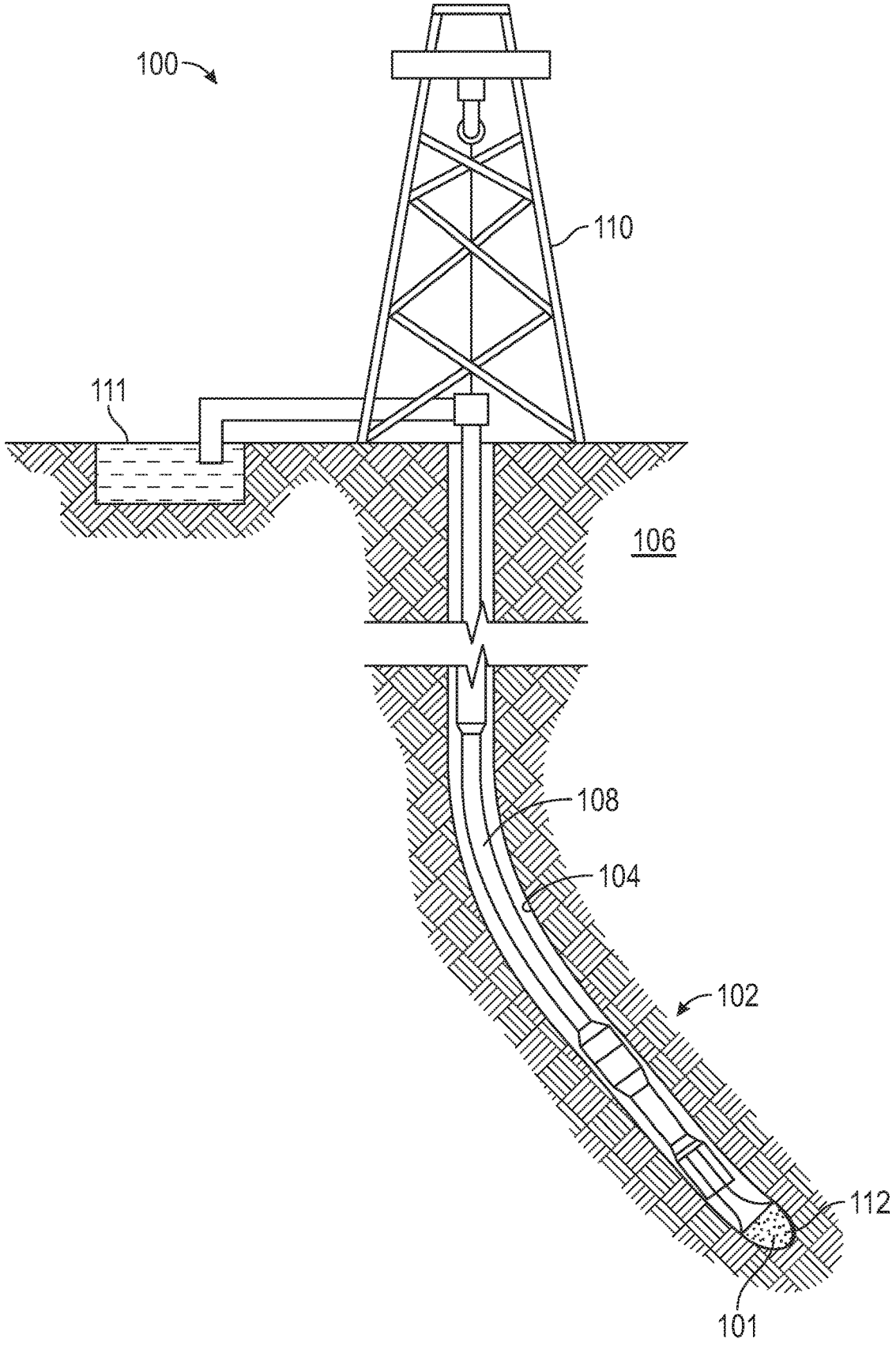
FIG. 1 is a schematic diagram of a wellsite including a drilling rig with a downhole tool having a drill bit that is advanced into the earth to form a wellbore.

FIG. 1 depicts a wellsite 100 in which the subject matter of the present disclosure may be employed. As generally shown, cutting elements 101 and assemblies and processes employing the cutting elements may be deployed at a downhole end of a downhole tool 102 into a wellbore 104 formed in a subterranean formation 106 by any suitable means, such as by a rotary drill string 108 operated from a drilling rig 110 to rotate a drill bit 112. A mud pit 111 is provided at the wellsite 100 to pass drilling fluid through the downhole tool 102 and out the bit 112 to cool the drill bit 112 and carry away cuttings out of the borehole during drilling.

The "drill string" may be made up of tubulars secured together end to end by any suitable means, such as mating threads, and the drill bit may be secured at or near an end of the tubulars that are secured together. As used herein, the term "wellbore" is synonymous with borehole and means the open hole or uncased portion of a subterranean well including the rock face which bounds the drilled hole. Also, as used herein, the terms "environ" refers to a subterranean area, zone, horizon and/or formation that may contain hydrocarbons.

The wellbore extends from the surface of the earth, including a seabed or ocean platform, and may penetrate one or more environs of interest. The wellbore may have any suitable subterranean configuration, such as generally vertical, generally deviated, generally horizontal, or combinations thereof.

The quantity of energy referred to as "energy of extrusion" means the portion of the total mechanical specific energy ("MSE") that is expended to extrude crushed rock particles across the faces of the cutting element(s) of the drill bit during drilling. As used herein, the term "extrudate" refers to crushed rock particles that are extruded across the face of the cutting element(s) during drilling.

Figure 2A:
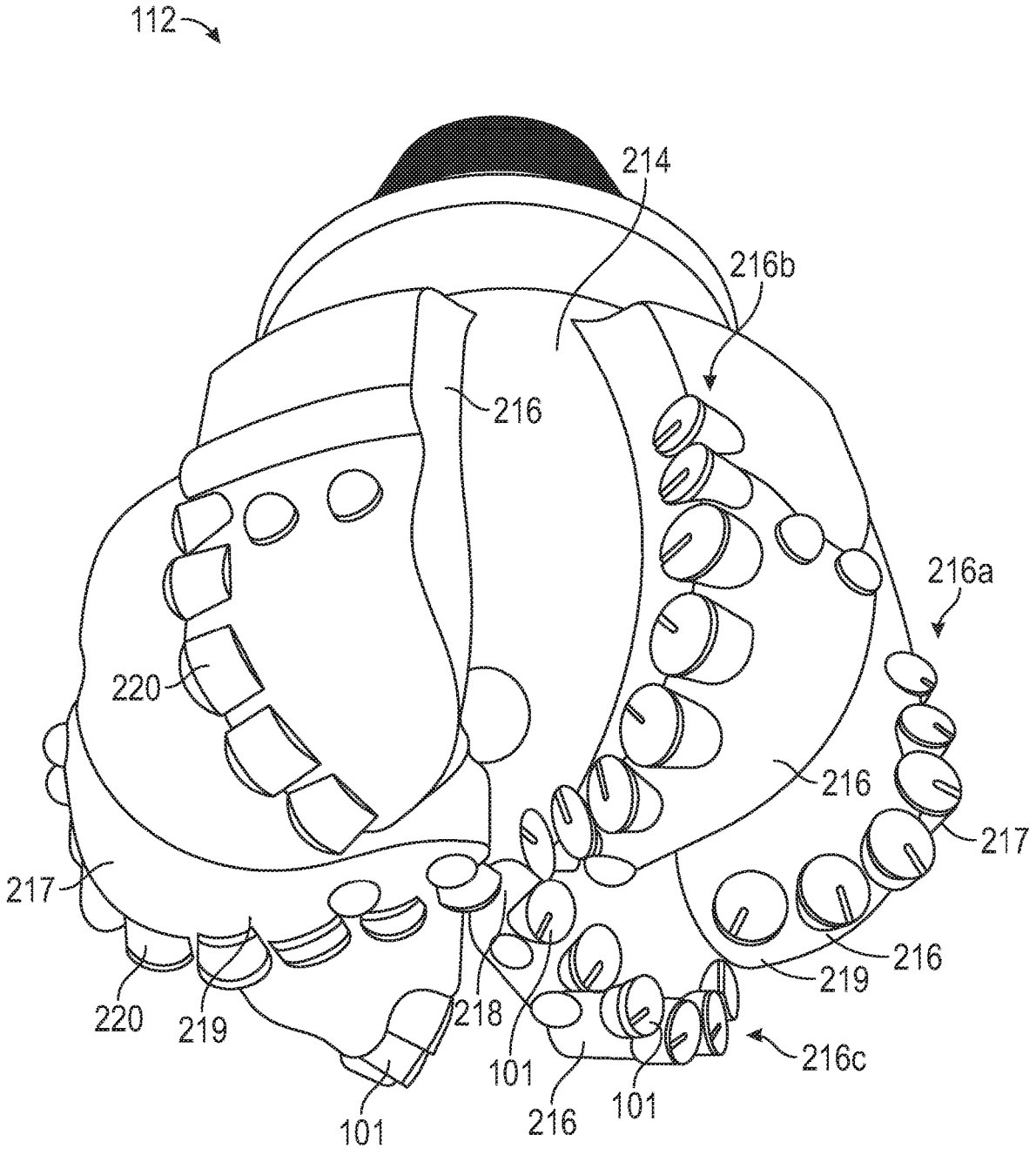
FIGS. 2A and 2B are perspective and end views, respectively, of a fixed cutter drill bit with cutting elements thereon.
Figure 2B:
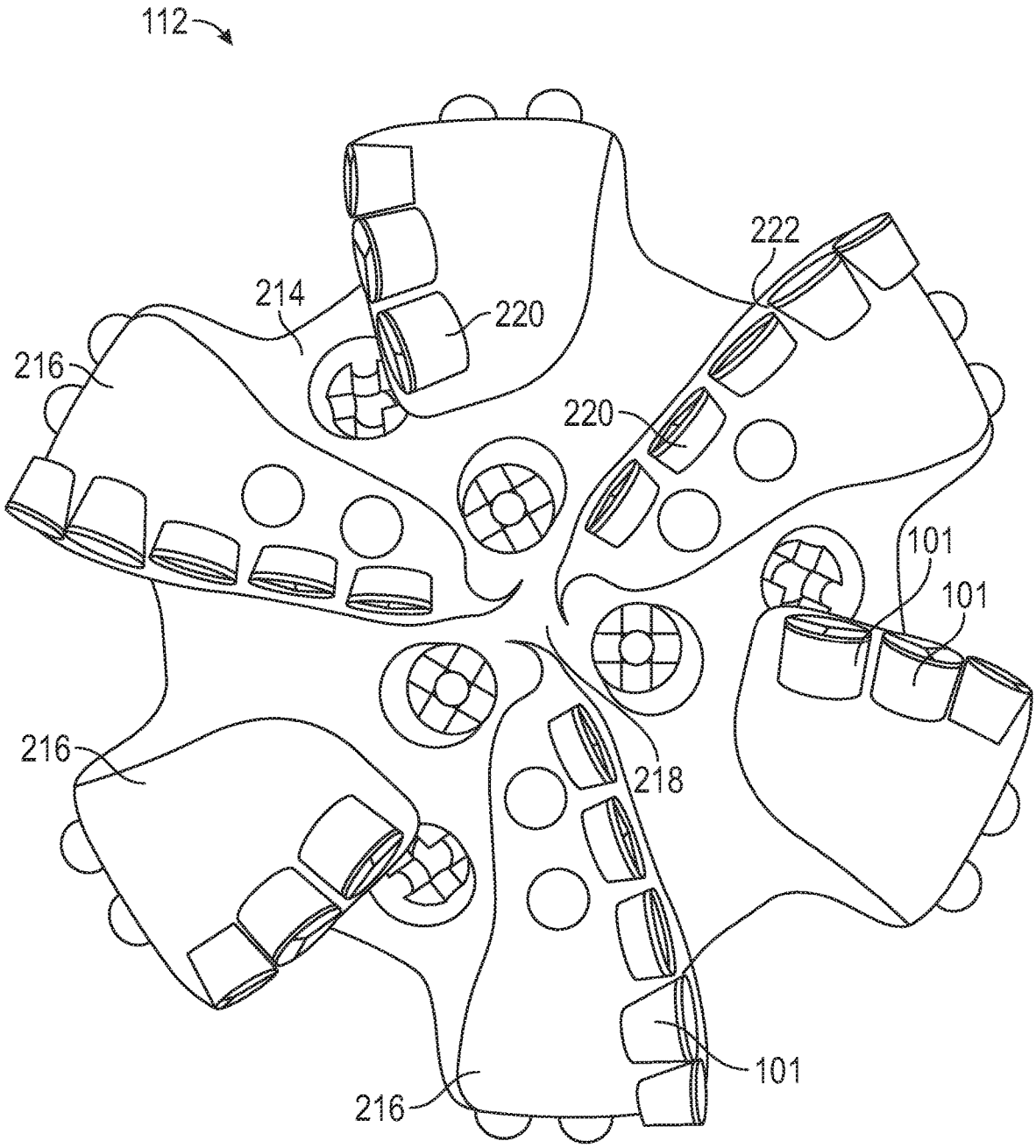

The cutting elements 101 described herein may be utilized in conjunction with any drill bit rotated by means of a drill string to form a wellbore in environs, such as a rotary drag-type bits. FIGS. 2A and 2B depict an exemplary drill bit 112 that may be used with the cutting elements 101 described herein. Drill bit 112 is a drag-type drill bit having a bit body 214 that includes one or more blades 216 that protrude from an outer periphery of the bit body 214. The blades 216 extend along a portion of the bit body 214, including the shoulder region 217 and the nose region 219, and terminate on or near the cone region 218, which is the central location about an end of the bit body 214 where the blades 216 converge. The bit body 214 may also be provided with one or more passages 222 between the blades 216 for conveying drilling fluid to the surface of the bit body 214 for cooling and/or cleaning exposed portions of the cutting elements 101 during drilling operations.

Cutting elements 101 are mounted in at least one of the blades 216 by positioning a portion of each cutting element 101 within a socket 220 and securing it therein by any suitable means, for example by brazing. The cutting elements 101 may be randomly positioned about the bit body 214 or may be confined to a specific area or areas of the cutting structure, such as only in the cone region 218 of the bit, or only on the shoulder region 217 of the bit, as examples. Further, the cutting elements 101 may be positioned in the sockets 220 at a desired orientation.

The orientation of the cutting elements 101 may optionally be selected so as to ensure that the leading edge of each cutting element 101 may achieve its intended depth of cut, or at least be in contact with the rock during drilling. For example, as shown in FIG. 2A, the cutting elements 101 are oriented in row 216*a* to have ridge 332 (described in more detail below) extending in a direction that is generally perpendicular to the edge of the blade 216 to which they are mounted. In the example shown, in row 216*b*, the ridges 332 of the cutting elements are directed away from the blade edge. In another example, the cutting elements 101 may be oriented in a pattern such that the ridge 332 points to a specific point, such as shown in row 216*c* in which the leading edge points towards the nose 219, and where the relative angle of each leading edge is shifted away from the nose 219 the further from the nose 219 the cutting element 101 is positioned. In yet another example, the orientation of the cutting elements 101 positioned about the nose 219 of the drill bit 112 may be offset at an angle, such as about 90 degrees, from an orientation of those cutting elements 101 positioned near a periphery of the bit body 214.

Cutting element 101 is mounted in bit body 214 such that its cutting face 328 (described in detail below) is exposed to the formation material, the cutting face including surface regions or portions having distinct functional roles in abrading/shearing, excavating, and removing rock from beneath the drill bit 112 during rotary drilling operations.

Figure 3A:
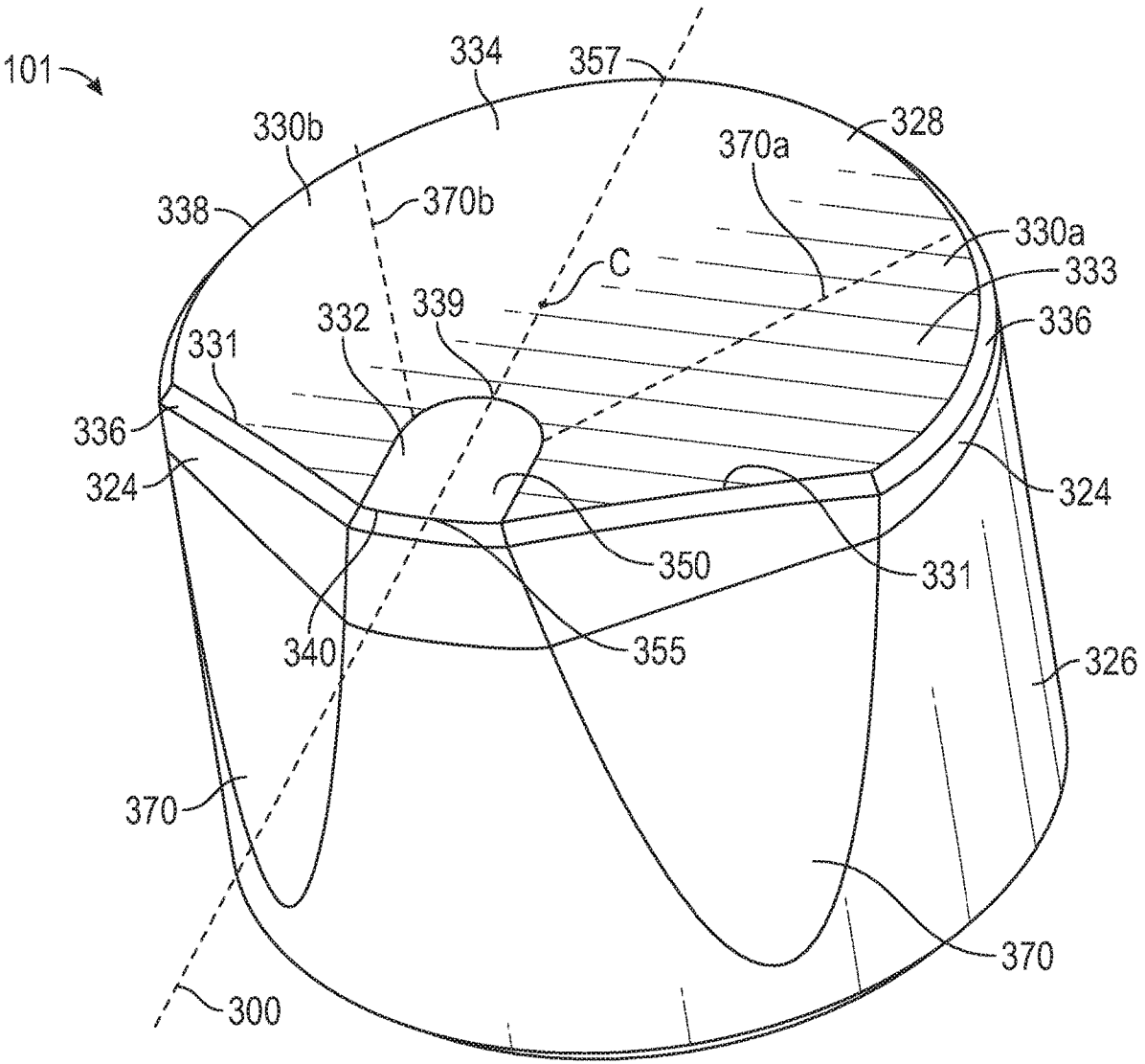
FIGS. 3A-3D are, respectively, perspective, top, front, and side views of one of the cutting elements suitable for use in the drill bit of FIGS. 2A-2B.
Figure 3B:
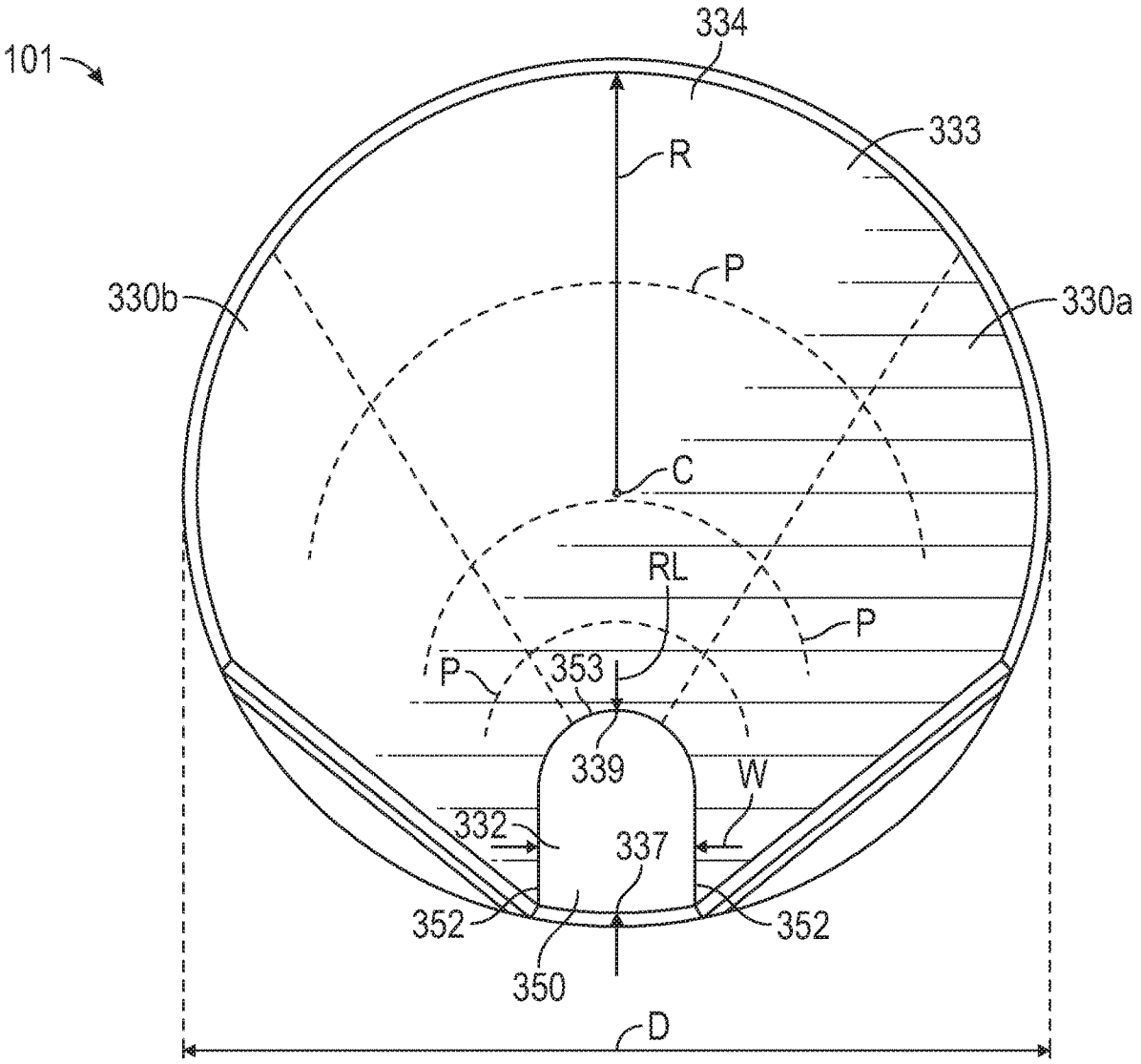
Figure 3C:
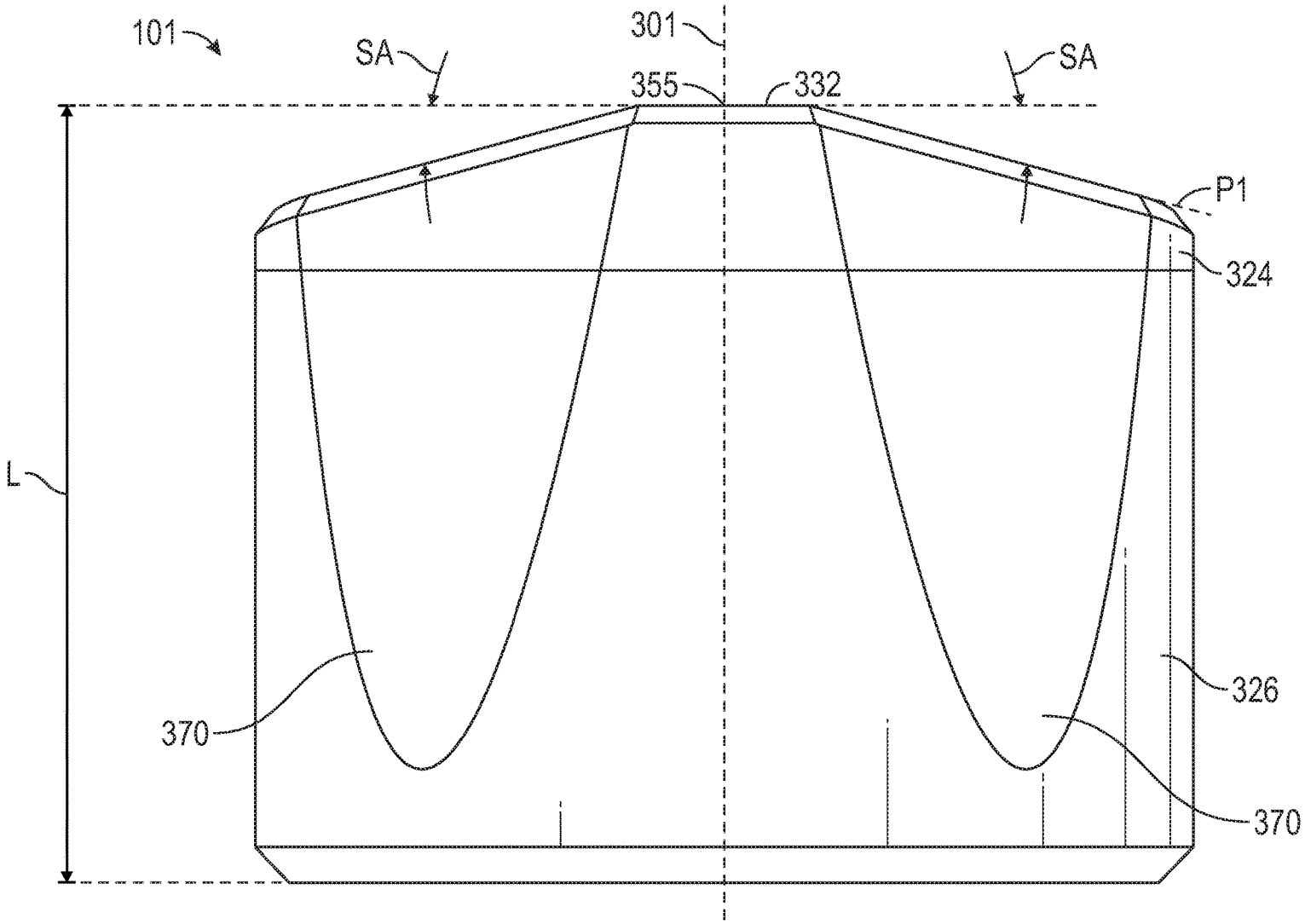

FIGS. 3A-3D depict cutting element 101 in greater detail. Each cutting element 101 includes a diamond (e.g., polycrystalline diamond ("PCD")) layer 324 bonded to a less hard substrate 326 and a central axis 301. While a single diamond layer 324 and substrate 326 are depicted, one or more layers of one or more materials may be provided as the layer, substrate and/or other portions of the cutting element 101. In the embodiment shown, cutting element 101 further includes a pair of planar faceted surfaces 370 ("facets") extending through portions of both the PCD layer 324 and substrate 326. Facets 370 are formed at an angle relative to the cutting element's central axis 301 (FIG. 3C)

The cutting elements described herein may be formed of various materials. For example, the substrate 326 may be made of tungsten carbide and the diamond layer may be formed of various materials including diamond. Other layers and/or other materials may optionally be provided. Part and/or all of the diamond layer may be leached, finished, polished, and/or otherwise treated to enhance durability, efficiency and/or effectiveness. Examples of materials and/or treatments, such as leaching are described in U.S. Pat. Nos. 9,441,422, 8,875,812, 8,945,720, 8,721,752, 8,997,900, and 8,910,730, and in Patent Publications WO2014/036283, WO2012/056196, and WO2012/012774, the entire contents of which are hereby incorporated by reference herein.

When mounted in a socket 220 of the bit body 214 as shown in FIGS. 2A-2B, cutting element 101 is positioned with diamond layer 324 extending outside of the socket 220 such that its cutting face 328, at the exposed end of the cutting element, is positioned to engage formation material and form the wellbore. The cutting element 101 may have any suitable general configuration, for example having a footprint of diameter D (e.g., about 16 mm in some embodiments) and being generally cylindrical along most of its overall length L (e.g., about 13 mm in some embodiments).

Referring again to FIGS. 3A-3D, cutting element 101 includes a cutting face 328 having a ridge 332 that, in this embodiment, is elongated and planar on its uppermost surface 350. The planar surface 350 defines the highest or uppermost point of cutting face 328. Cutting face 328 further includes a non-planar and continuously curved surface 333 that makes up all of the cutting face 328 that is not part of ridge 332 and, in this way, is referred to herein as a surface that "surrounds" the ridge or as a "surrounding surface" 333. As used herein, the term "continuously curved" means and relates to surfaces that can be described as consisting of ridgeless surfaces that are free of abrupt changes in radii and free of relatively small radii (0.080 in. or smaller) as have conventionally been used in cutting elements to round off transitions between adjacent distinct surfaces or to "break" sharp edges. Surrounding surface 333 includes a pair of side regions 330*a,b* and a ramp region 334. A chamfer 336 extends about the cutting face 328 and defines the periphery 338 of the cutting face.

Referring still to FIGS. 3A-3D, ridge 332 extends from an outermost end 337 in a direction towards the center C of the cutting face 328 and terminates in a central most end 339 that is curved. In this exemplary embodiment, ridge 332 extends along a plane 300 that bisects cutting face 328 and that contains central axis 301, plane 300 intersecting the periphery 338 at leading point 355 and trailing point 357. In other embodiments, ridge 332 may be offset from or skewed relative to bisecting plane 300. Ridge 332, like ramp region 334, separates the side regions 330*a,b* from one another. In this embodiment, ridge 332 extends in a direction that is generally perpendicular to the outer diameter (OD) of the cutting element and extends between a pair of facets 370 that are positioned on either side of ridge 332. As best shown in the top view of FIG. 3B, one facet 370 is located on each side of ridge 332 and each extends through the diamond layer 324 and partially through the substrate 326. In this manner, the periphery 338 of the cutting surface is not entirely circular, but instead includes two linear edges 331 formed at the intersection of a side region 330*a,b* and the chamfer 336. Leading edge 340 is curved and follows the generally cylindrical shape of cutting element 101 in the embodiment shown in FIGS. 3A-3D. Also in this embodiment, the outermost ridge end 337 is positioned at leading edge 340, such that the ridge extends all the way to the periphery 338; however, ridge 332 may be formed to have its outer end 337 spaced apart an offset distance from periphery 338. Side regions 330*a,b* extend from periphery 338 toward ridge 332 and also toward ramp region 334. Side regions 330*a,b* are non-planar and continuously curved. Ramp region 334 is also non-planar and continuously curved such that side regions 330*a,b* and ramp region 334 are thus free of planar areas (i.e. free of "flats"). As best shown in the front profile view of FIG. 3C, although continuously curved in the manner described above, side regions 330*a,b* present a linear profile that extends from ridge 332 to the periphery 338 at a slant angle SA of about 10 degrees in this exemplary embodiment. The slant angle may be between about 2 degrees to about 20 degrees in other embodiments, it may be still larger. As shown in FIG. 3C, the slant angle SA is the angle formed between a plane containing the upper planar surface 350 of ridge 332 and the side region 330*a,b* when viewed in a profile view looking along reference plane 300 toward leading point 355.

Figure 3D:
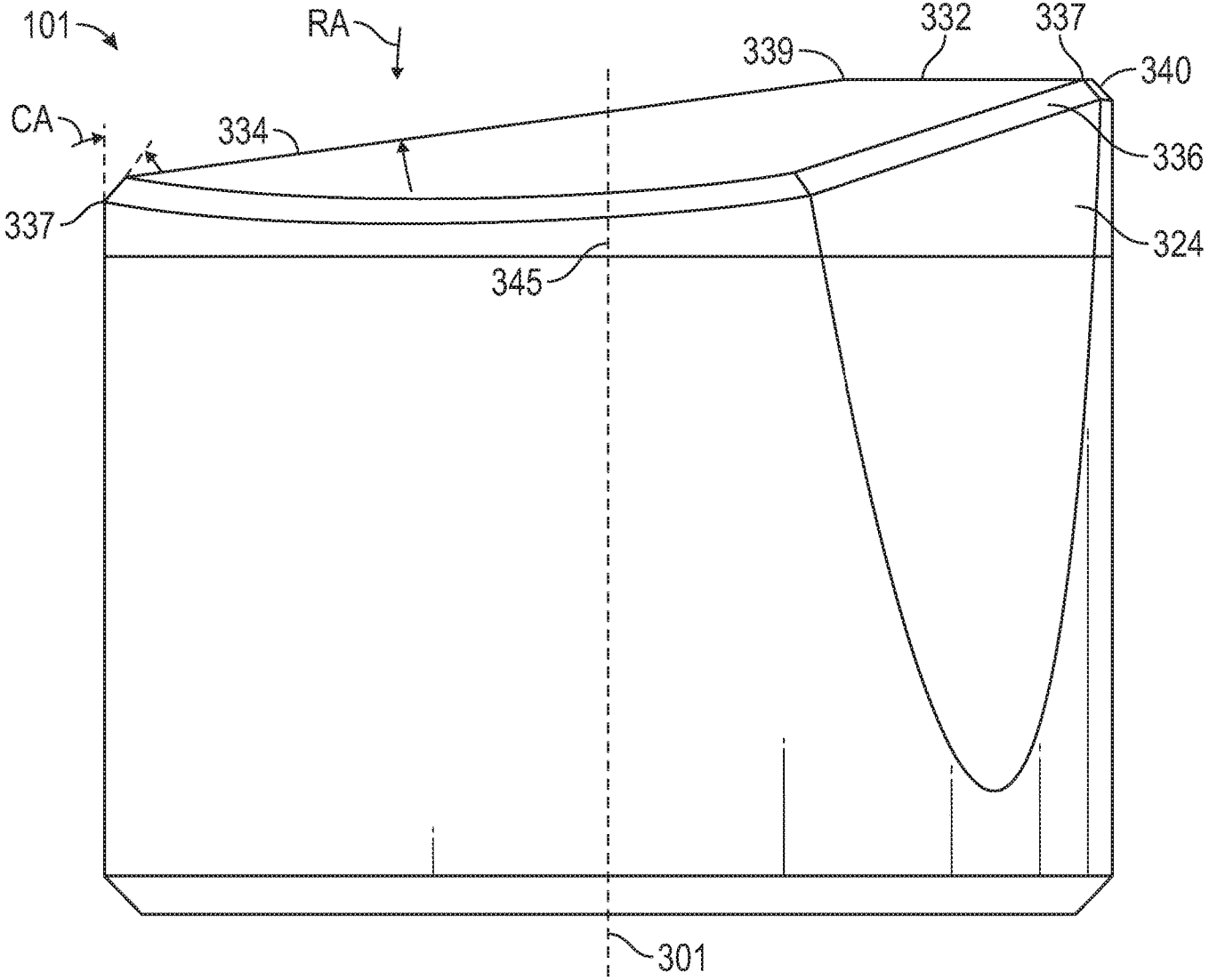
Figure 4A:
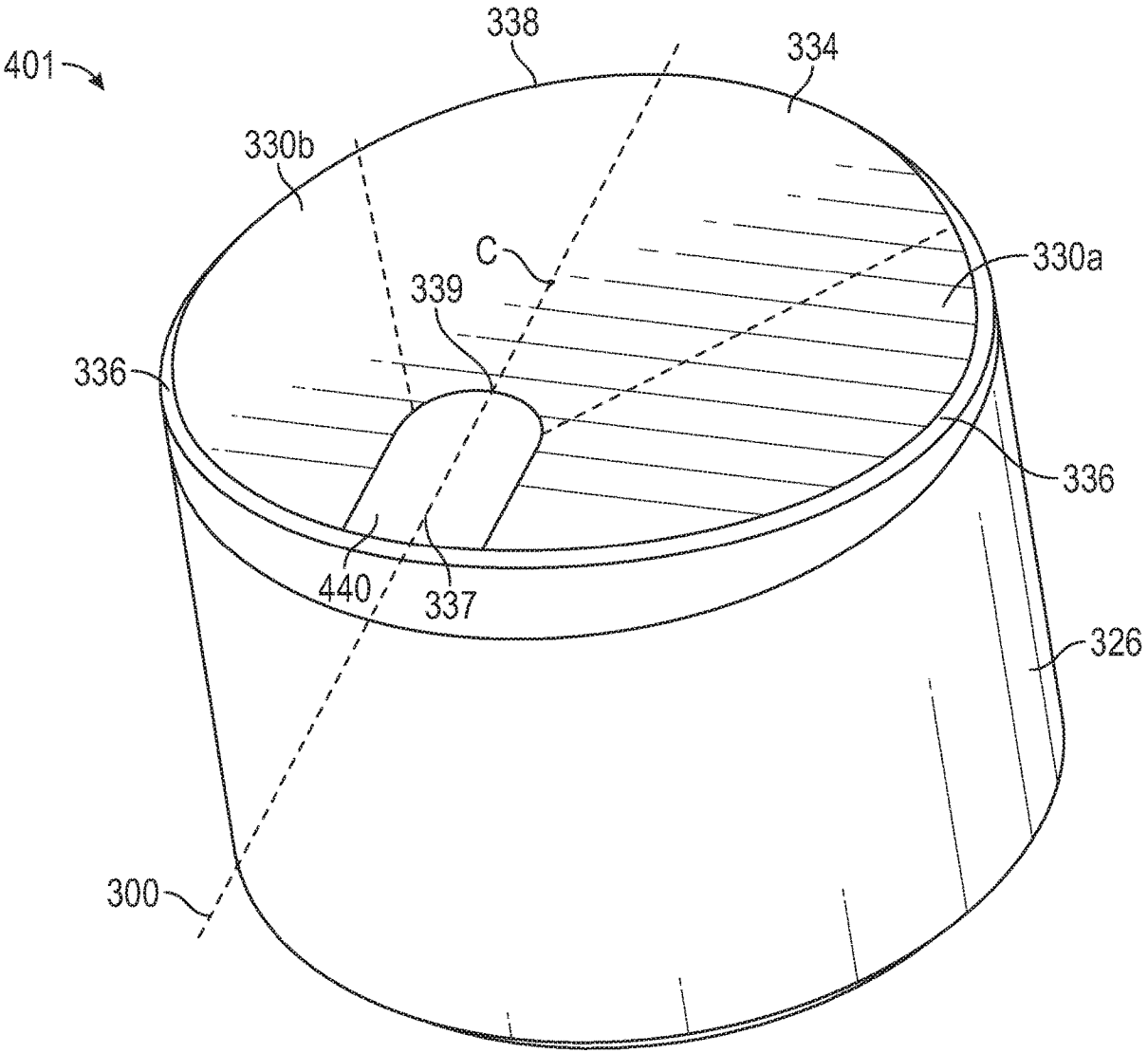
FIGS. 4A-4D are, respectively, perspective, top, front, and side views of another of the cutting elements suitable for use in the drill bit of FIGS. 2A-2B.
Figure 4B:
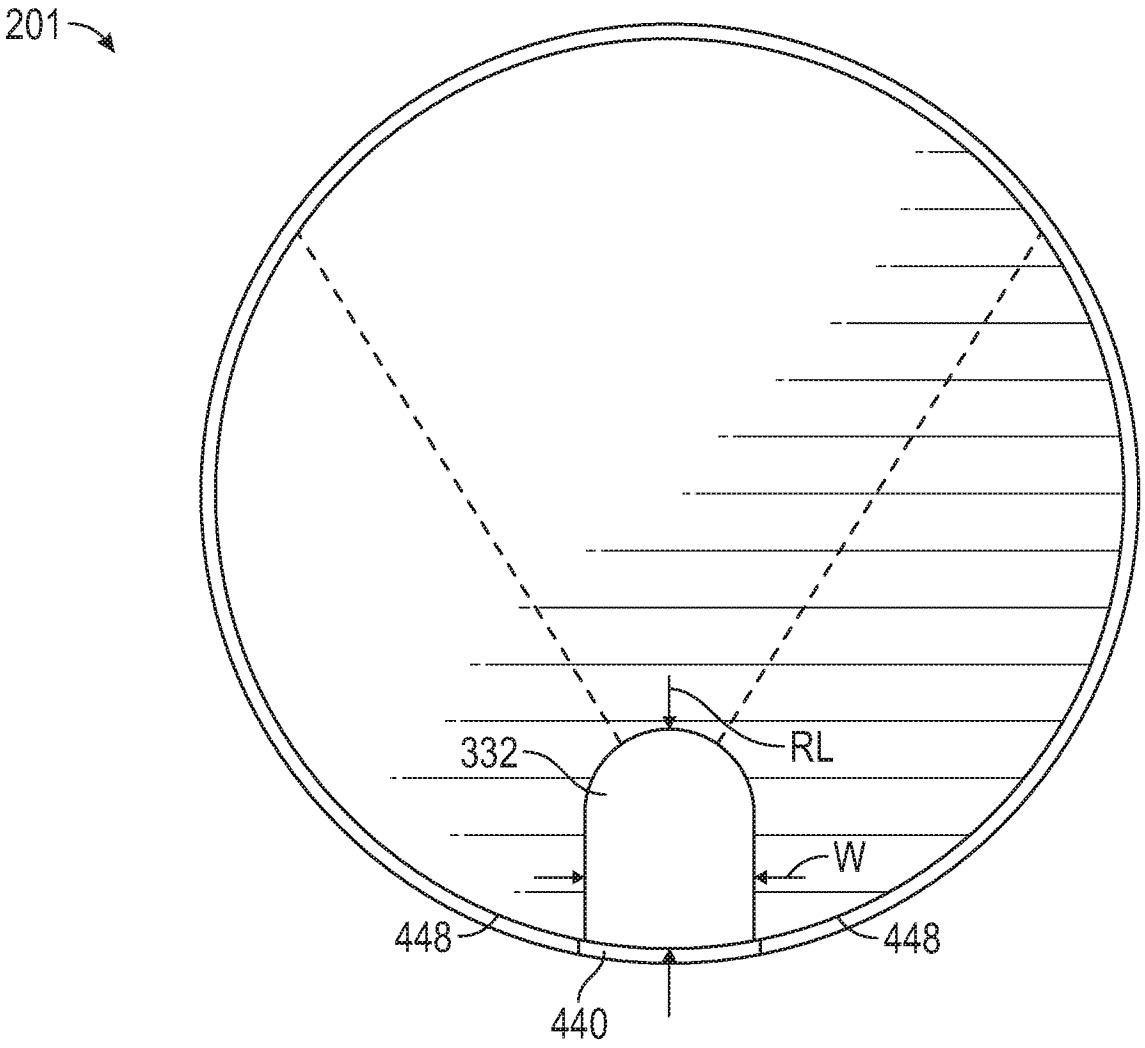
Figure 4C:
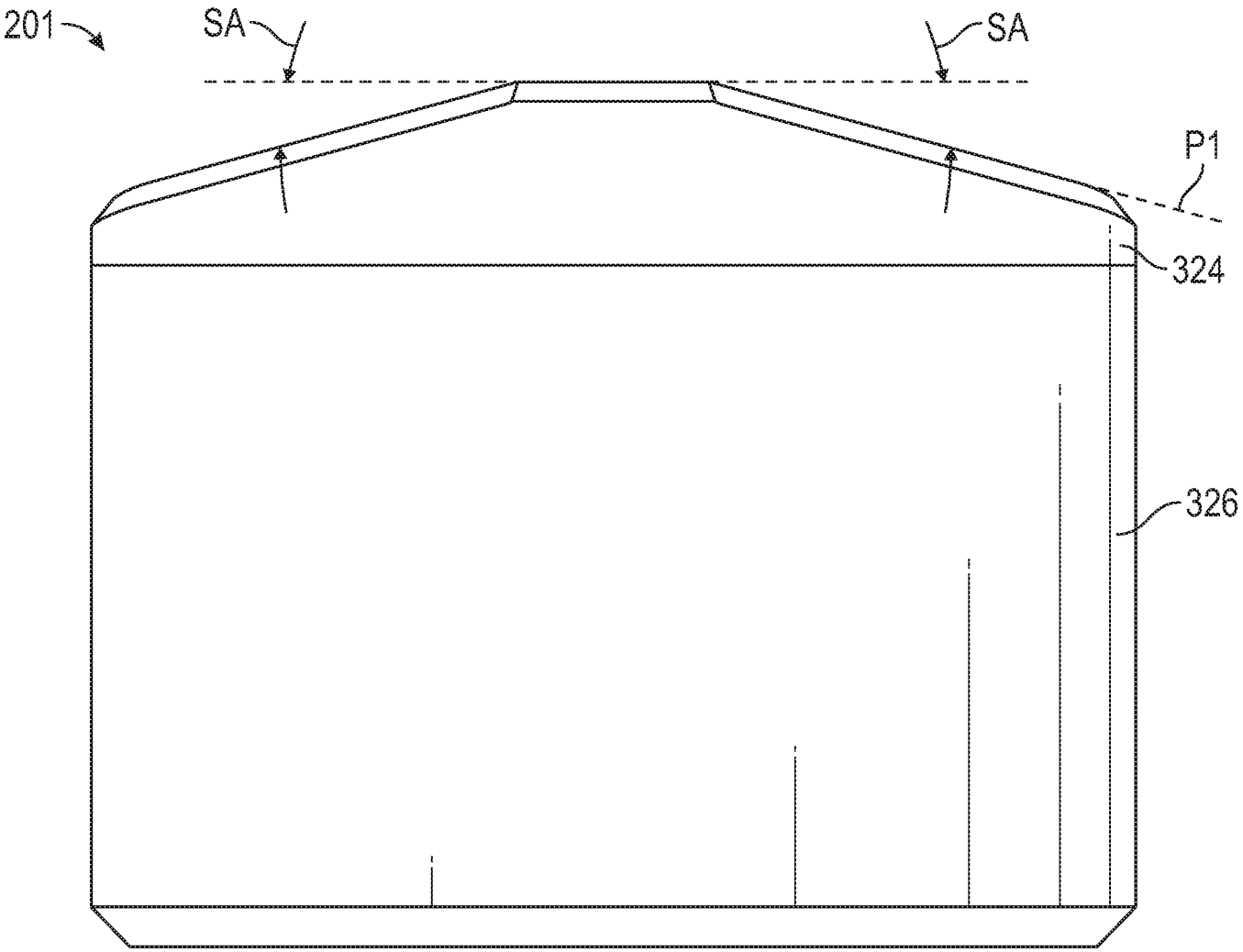
Figure 4D:
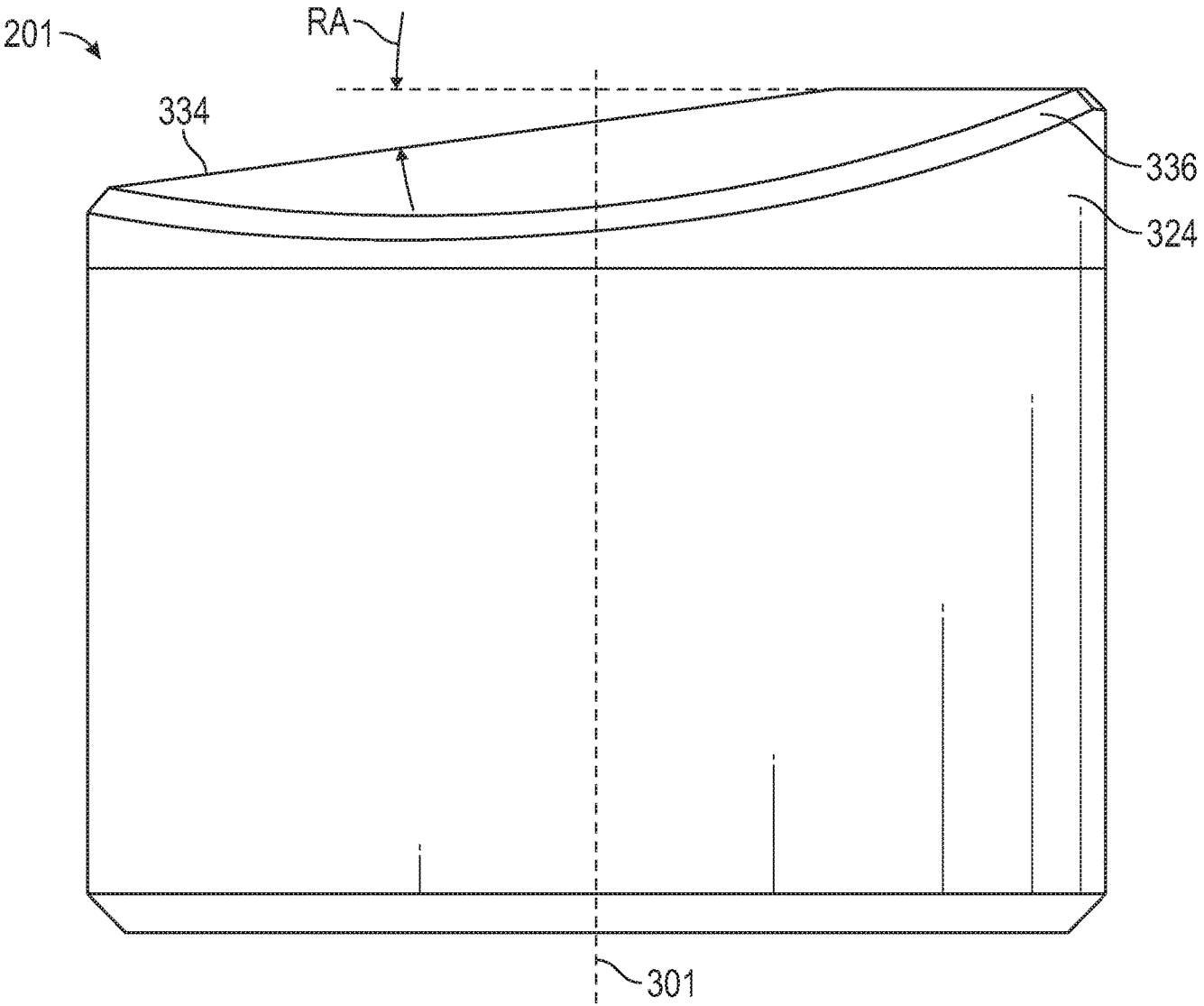

Referring now to FIG. 3D, although continuously curved, ramp region 334, in profile view, is linear from the ridge end 339 to periphery 338 and forms a ramp angle RA of about 7 to 10 degrees in the embodiment shown. In other embodiments the ramp angle RA may be from about 2 to 10 degrees. In other embodiments, the ramp angle may be greater than 10 degrees or less than 2 degrees. As shown in FIG. 3D, the ramp angle RA is the angle formed, in a profile view, between ramp region 334 and the planar surface 350 of ridge 332 when viewed perpendicular to reference plane 300 (FIG. 3A) and parallel to upper planar surface 350 of ridge 332.

To further explain the continuously curved characteristic of surrounding surface 333 and its constituent regions, it is to be understood that along the various curved paths P shown in FIG. 3C between ridge 332 and periphery 338, the surrounding surface 333 is both free of planar surfaces and free of abrupt changes in radii, including when moving on a path P from side region 330*a* (having a given slant angle) to ramp region 334 (having a ramp angle that, in this example, is different from the slant angle.) To further explain, and referring to FIG. 3B, the intersection of ridge 332 with surrounding surface 333 includes a pair of parallel sides 352 that are joined by a curved segment 353. Considering a first line extending perpendicular from a side 352 and extending downward from ridge upper surface 350 at the slant angle previously defined, the side surface 330*a* may be visualized as being the surface formed as that line is moved or swept along the straight side 352. Likewise, considering a second line extending perpendicular to a tangent at a point along curve 353 and forming the ramp angle previously defined, the ramp region 334 may be visualized as being the surface formed as second that line (always kept perpendicular to a tangent) is swept along curved surface 353 from one side 352 to the other side 352. Although the slant angle and ramp angle are different, the transition between the different surfaces formed by the different line sweeps is nevertheless made gradually so that there are no ridges, discontinuities or abrupt changes in the surface 333, the surface instead being continuously curved as defined herein. Ramp region 334 extends from periphery 338 toward ridge 332 and extends between and separates side regions 330*a,b*. As best shown in FIGS. 3A and 3B, the side regions 330*a,b* are shown to be generally wedge shaped regions that are symmetrical relative to each other and that terminate at edges or sides generally represented by dashed lines 370*a* and 370*b*, respectively. However, lines 370*a,b* are depicted merely to help describe the spatial relationship of the side regions 330*a,b* relative to the ramp region 334, but do not represent ridges, valleys or any other discontinuity between ramp region 334 and the side regions 330*a,b*. Although lines 370*a,b* shown in FIGS. 3A, 3B represent general transitions between side regions 330*a,b* and ramp region 334, it is to be understood that the lines do not represent sharp transitions such as ridges or valleys. Instead, regions 330*a,b* and 334 are blended together to form the continuously curved surrounding surface 333 which are free from abrupt changes in radius.

In the exemplary embodiment shown ridge 332 extends from outer end 337 at leading edge 340 toward the center C of the cutting face 328, center C being contained in cutter axis 301. Ridge 332 thus extends along a portion of the diameter of the face 328, for example, extending for a length RL (FIG. 3B) from about 5% to about 50% of the diameter D of the face 328. A ridge length of about 20% D to about 40% D may be employed. In this manner, ridge 332 defines a protrusion extending from chamfer 336 at the periphery 338 to the central-most end 339 of the ridge. Ridge end 339 is curved where it intersects ramp region 334 in the embodiment shown. The ridge 332 may have a length that is predetermined to be best for physically splitting apart and extruding rock particles or extrudates and directing the smaller, split extrudate portions onto the side regions 330*a,b*. An exemplary length of ridge 332 from end 337 at periphery 338 to end 339 is about 8 mm for a cutting element having a diameter of about 16.1 mm.

In the embodiment shown in FIGS. 3A-3D, the planar top surface 350 of ridge 332 includes the highest point of the cutting face 328. In embodiments in which the ridge does not extend to the center C of the cutting face, the highest point of the cutting face is thus offset from the central cutter axis 301 and is not aligned with the center C. In some embodiments, such as where the ridge length RL 332 is less than 25% of the diameter D, the highest point in the cutting face is closer to the periphery 338 than it is to center C. In one example, the offset distance is 20% of D or more.

Further, in the embodiment shown in FIGS. 3A-D, ridge 332 has a uniform width along its entire length. Ridge 332 may have a width W of, for example, about 0.50 mm. Ridge 332 may have a uniform height along the entire length thereof as shown in FIGS. 3A-3D, or may possess a height that varies, such as by having a height that increases from the end proximate leading edge 340 to central most end 339.

Chamfer 336 extends along periphery 338 and defines the leading edge 340 and linear edges 331. The leading edge 340 may be dimensioned to achieve a generally predetermined depth-of-cut into the formation. The chamfer 336 may extend around the periphery 338 at a chamfer angle CA (FIG. 3D) of about 45 degrees (or as desired from about 15 degrees to about 75 degrees).

As described above, in some embodiments, the slant angle and the ramp angle are different on a given cutting element. Given that each such angle is measured relative to the same planar upper surface 350 of ridge 332, the difference in slant angle vs. ramp angle will lead to different thicknesses of the PCD at the periphery 338 of the element's cutting face. This is best shown with reference to cutting element 101 depicted in FIGS. 3A-3D where ramp angle RA is less than slant angle SA. In this arrangement, the thickness of the diamond at trailing point 357 is greater than the thickness of the diamond at a point 345 (FIG. 3D) located along the periphery 338 and 90 degrees from the trailing point. By selecting various slant angles and ramp angles, the thickness of the PCD layer can be varied so as to best tailor a cutting element 101 to withstand expected forces, to have the required durability, to make the desired depth of cut, and to meet other particular cutting demands of a given drilling application. As such, depending on a cutting element's position in a drill bit, the slant and ramp angle may differ from cutting element to cutting element within the bit, as well as along the periphery of each cutting element.

In operation, drilling fluid passing through the downhole tool 108 and out the drill bit 112 (FIG. 1) may flow through the passages 222 and over the cutting element(s) (e.g., 101) in the blades 216 (FIG. 2). Cutting elements 101 are mounted in the blades 216 such that their leading edge 340 and the chamfer 336 engage formation material at the wall of the wellbore such that extrudate is drawn along the pair of side regions 330*a,b* while drilling. The leading edge 340 of the cutting elements(s) may engage and dislodge rock along the wellbore to form extrudates. The side regions (e.g., 330*a,b*) may direct opposing forces to extrudates at positive non-zero angles to the two-dimensional plane of the leading edge 340. These forces may urge the extrudates into the drilling fluid until such point in time when the surface area of each extrudate exceeds a critical value and the extrudate is broken off into the flow regime of the drilling fluid. The ramp (e.g., 334) may be used to guide or direct the drilling fluid toward the cutting face 328 to reduce interfacial friction between the working surface and rock extrudate and carry extrudate away as it is dislodged about the leading edge 340.

The configuration of the cutting elements may split extrudate in smaller portions without interrupting extrudate formation in such a way that limits the volume and mass (less energy of formation) of the extrudate. In this manner, reduced frictional forces between the cutter working surface and rock extrudate may result in extrudate removal with less energy of extrusion. Accordingly, less input energy may be required to drill at given rate of penetration, thereby reducing MSE while drilling.

Another cutting element 401 suitable for use in the drill bit shown in FIGS. 2A-2B in place of cutter element 101 is depicted in FIGS. 4A-4D. Cutting element 401 is substantially identical to element 101 previously described except that element 401 lacks facets 370 and does not include a linear edge 331 on either side of its leading edge 440. As shown in FIGS. 4A-4D, leading edge 440 of cutting element 401 is curved and the entire periphery 448 of the cutting face follows the generally cylindrical shape of the element 401. In all other respects, cutting element 401 and its features are completely understood by the previous description of cutting element 101.

Figure 5B:
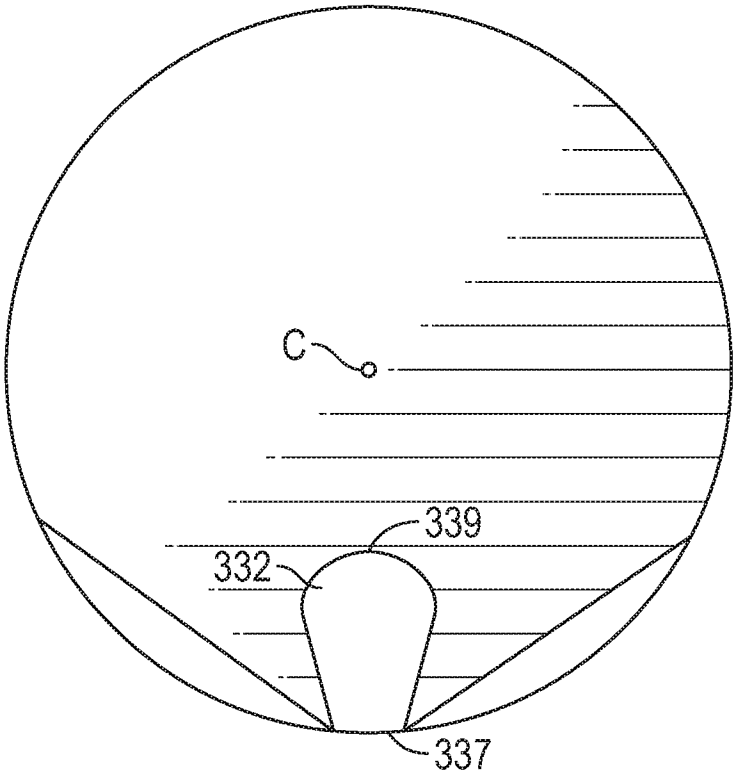
FIGS. 5A and 5B are top views of another of the cutting elements suitable for use in the drill bit of FIGS. 2A-2B.
Figure 5A:
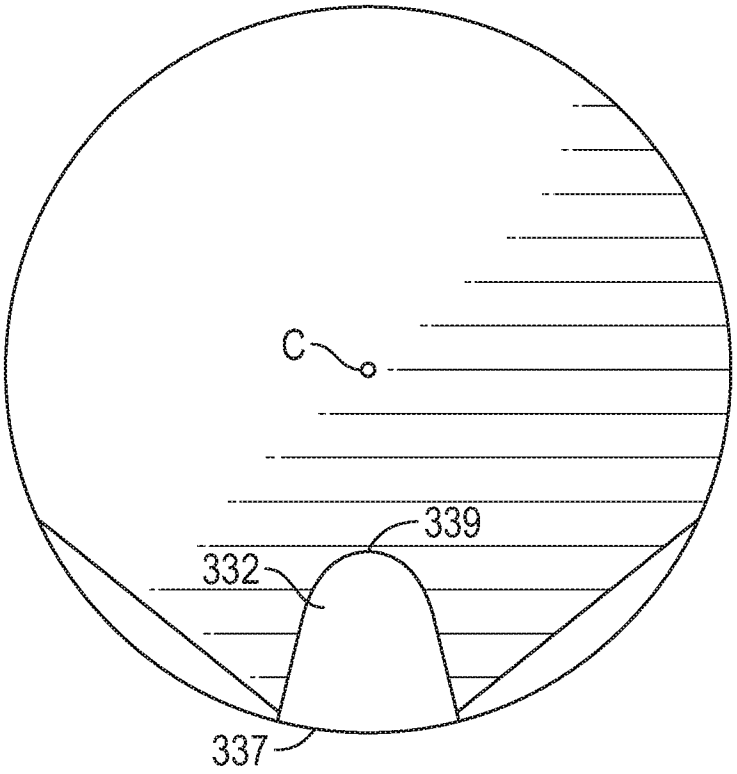

FIGS. 5A and 5B depicts views of additional embodiments of a cutting element suitable for use in the drill bit shown in FIGS. 2A-2B in place of cutter element 101. As shown in FIG. 5A, cutting element 501 has a ridge 332 that varies in width W, the width tapering so as to be narrower at outermost end 337 adjacent to leading edge 340 and wider at central most end 339. In FIG. 5B, element 502 is shown having a ridge that is wider at outermost end 337 adjacent to leading edge 340 and narrower at end 339. In all other respects, cutting element 501, 502 and their features are completely understood by the previous description of cutting element 101. Elements 501, 502 may employ facets 370 as shown, or be free of such facets.

Figure 6A:
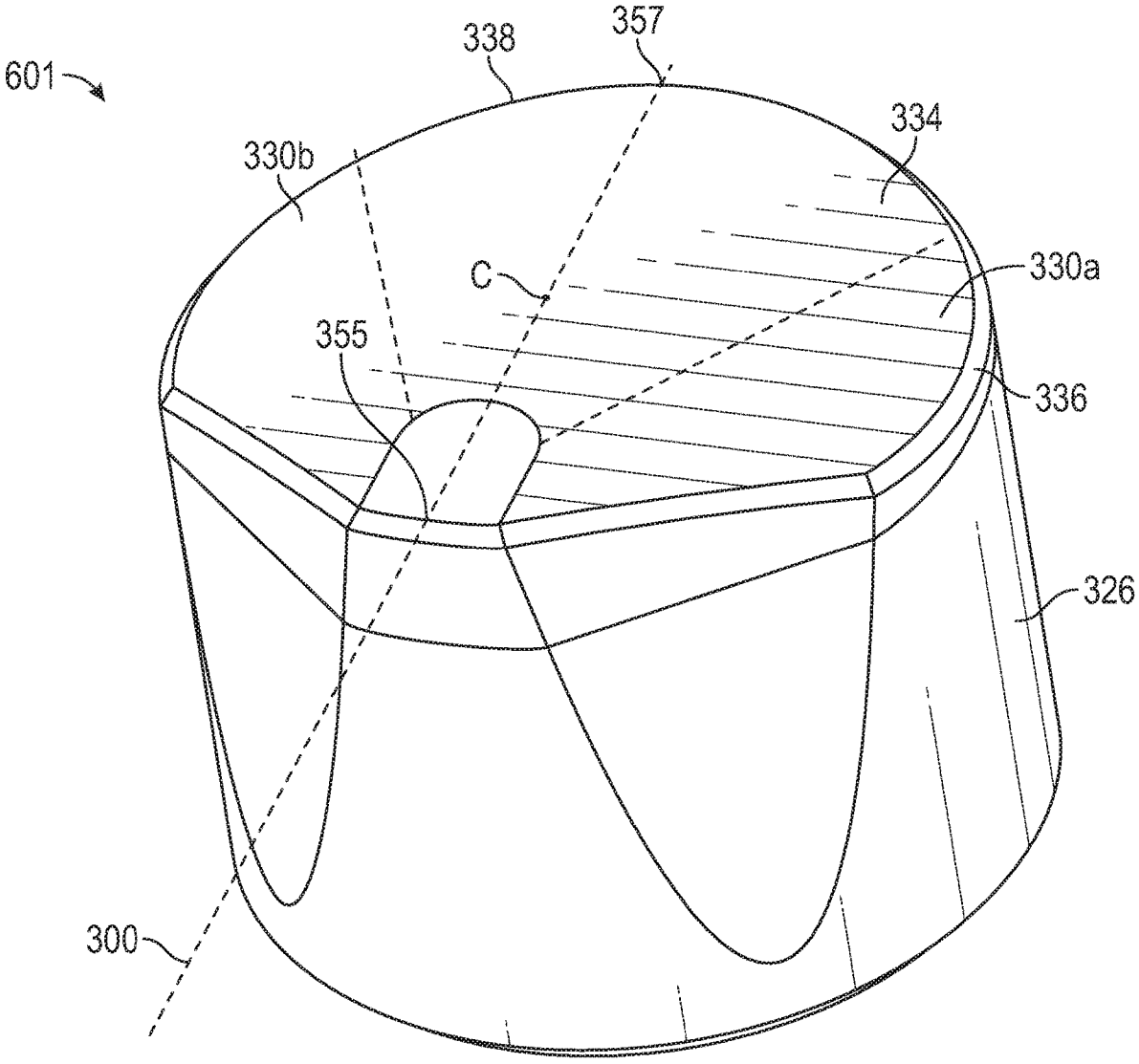
FIGS. 6A-6D are, respectively, perspective, top, front, and side views of another of the cutting elements suitable for use in the drill bit of FIGS. 2A-2B.
Figure 6B:
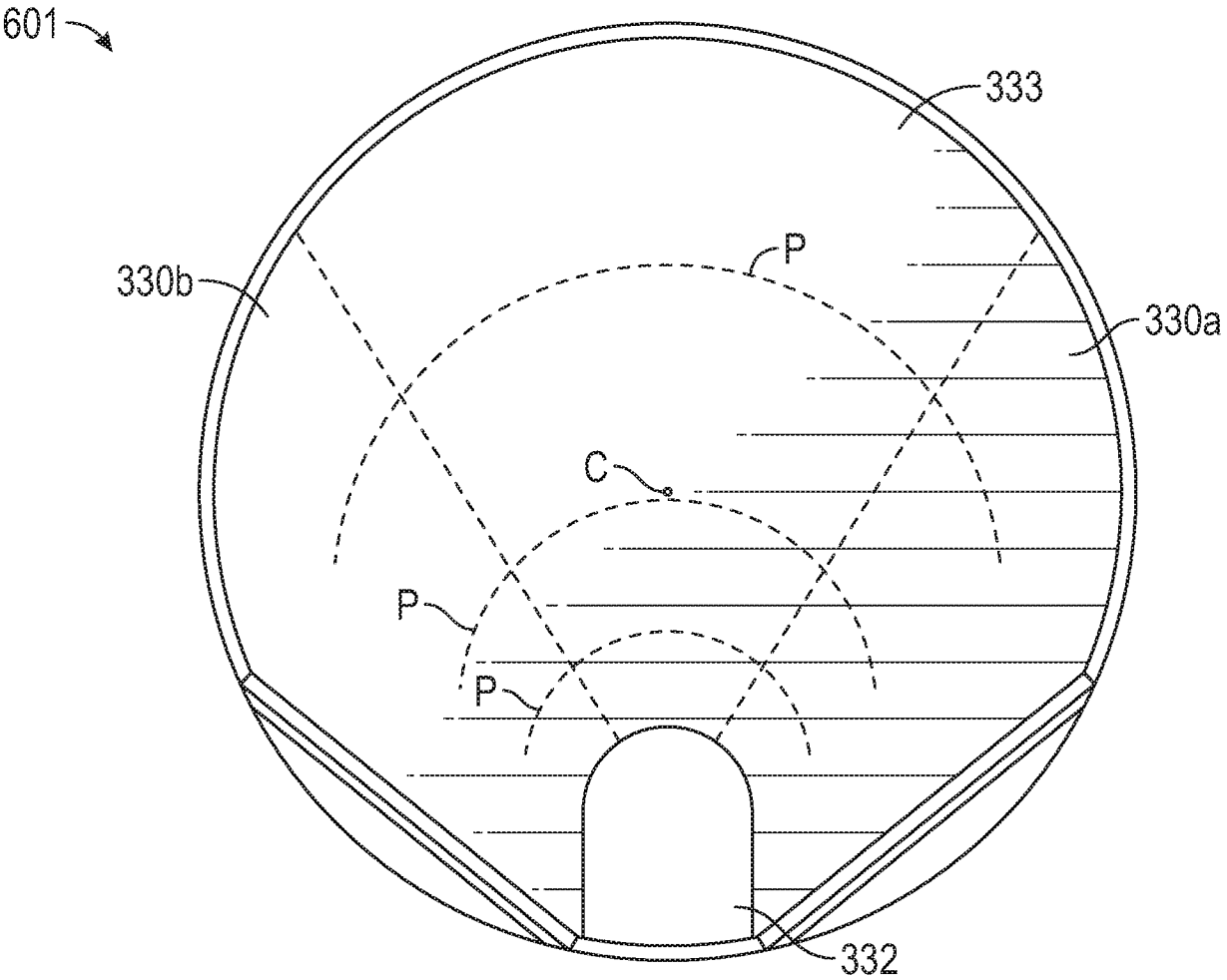
Figure 6C:
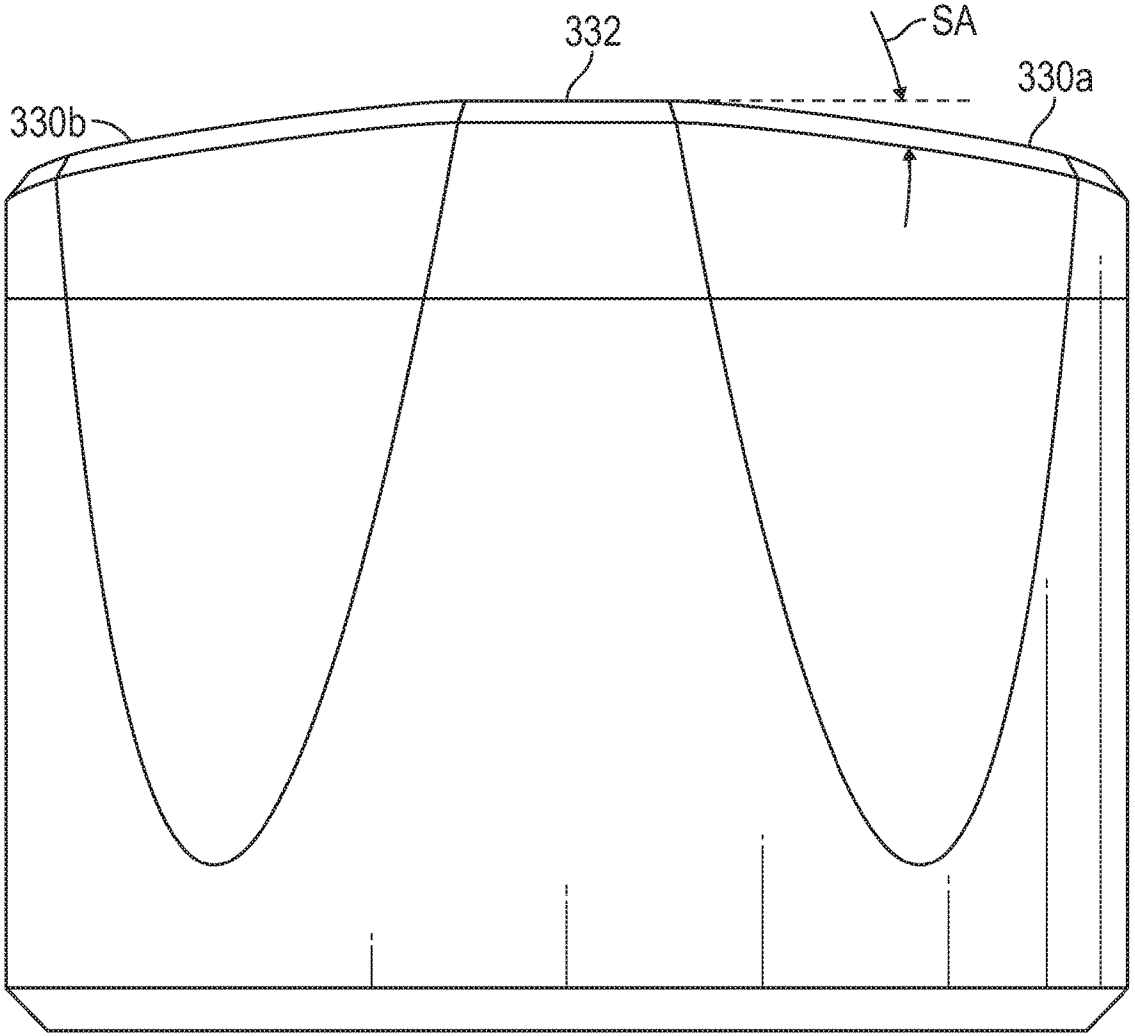
Figure 6D:
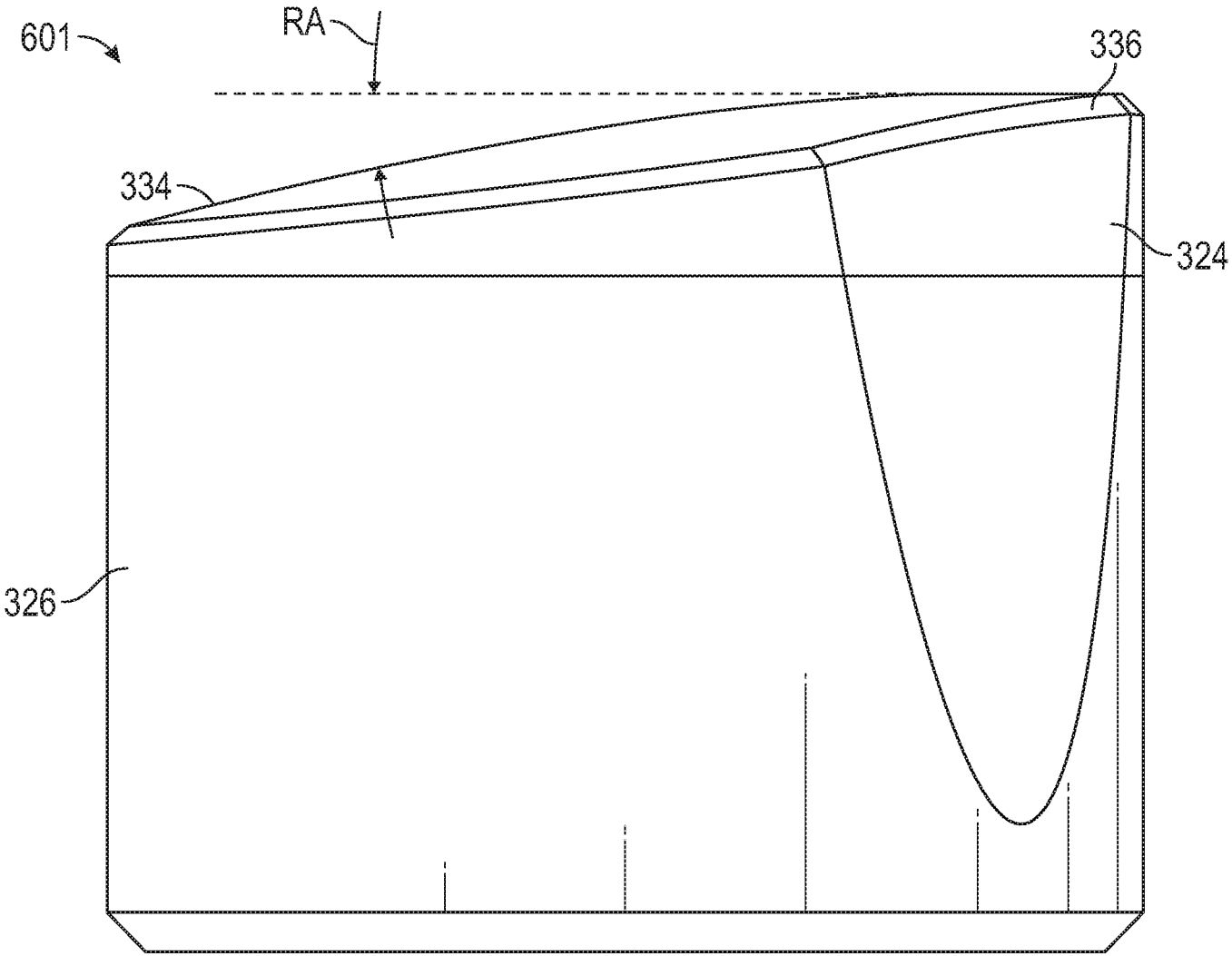

Another cutting element 601 suitable for use in the drill bit shown in FIGS. 2A-2B in place of cutter element 101 is depicted in FIGS. 6A-6D. Cutting element 601 is substantially identical to element 101 previously described except that the side regions 330*a,b* and ramp region 334, in profile view, are slightly convex rather than linear as was the case in the previously-described embodiments. More specifically, as shown in FIG. 6C, side regions 330*a,b* are slightly bowed upward and thus convex between periphery 338 and the planar upper surface 350 of ridge 332. Likewise, as shown in FIG. 6D, ramp region 334 is slightly bowed upward between periphery 338 and the planar upper surface 350 of ridge 332. In a specific example, where cutting element 601 has a diameter of about 16.1 mm, side regions 330*a,b* and the ramp region 334 are formed with a radius of curvature of about 70 mm. In other embodiments, the radius of curvature of the ramp region 334 may differ from the radius of curvature of the one or both of the side regions 330*a,b*, and the radius of curvature of the side regions may differ from each other. Varying the radius of curvature along the surrounding surface 333 allows the bit manufacturer to make cutting elements with different diamond thicknesses from region to region on the cutting face and, in particular, to vary the diamond thickness and relief along the periphery so as to optimum performance and durability for a given formation. In all other respects, cutting element 601 and its features are completely understood by the previous description of cutting element 101. For example, side regions 330*a,b* and ramp region 334 of cutting element 601 are continuously curved such that the intersection of regions having different curvatures are free of sharp transitions all along the curved paths P shown in FIG. 6B. Elements 601 may employ facets 370 as shown, or be free of such facets.

Figure 7A:
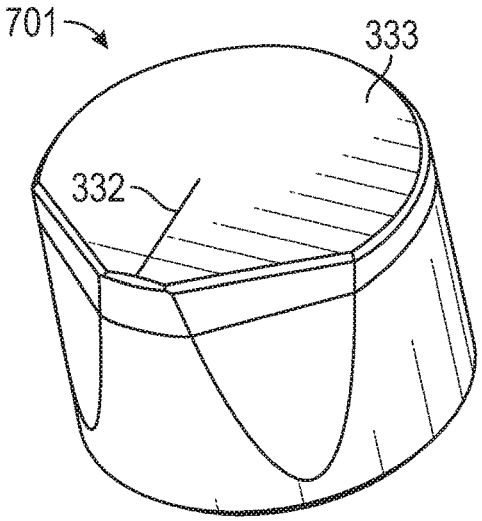
FIGS. 7A-7E are, respectively, perspective, front, side, top, and rear views of another of the cutting elements suitable for use in the drill bit of FIGS. 2A-2B.
Figure 7B:
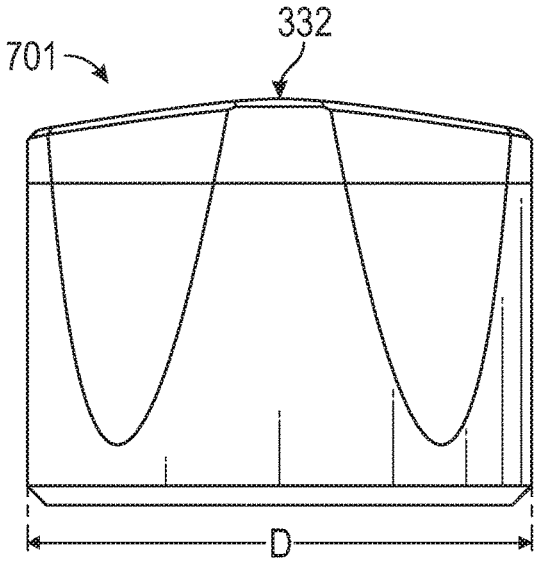
Figure 7C:
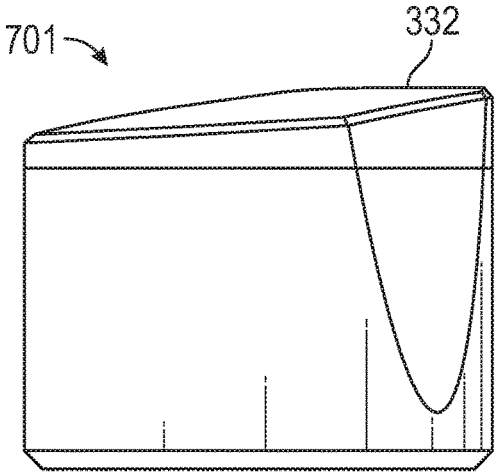
Figure 7D:
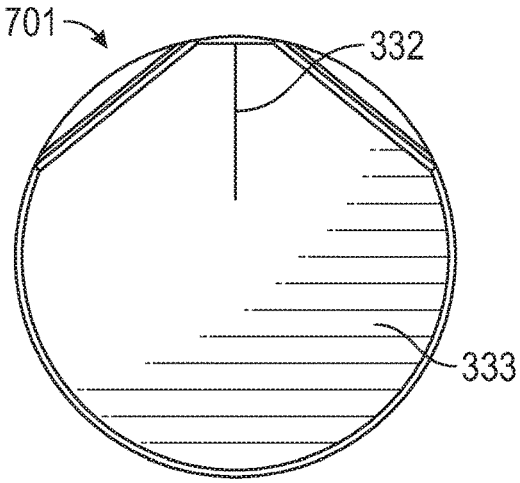
Figure 7E:
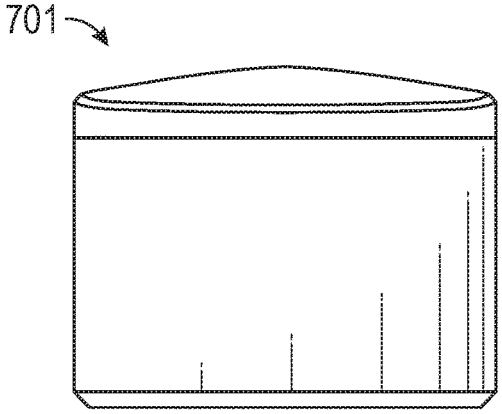

Another cutting element 701 suitable for use in the drill bit shown in FIGS. 2A-2B is depicted in FIGS. 7A-7E. As best shown in FIGS. 7A and 7D, the width of ridge 332 is a very narrow relative to, for example, ridge 332 shown in FIGS. 3A and 4A. With cutter element 701, ridge 332 has a width W that is 5% or less than the diameter D. As with the embodiments described previously, ridge 332 defines the highest point on the cutting face, and the surrounding surface 333 is continuously curved. Employing a cutting element having a very narrow ridge 332 can impart greater force per unit area on the formation, and thus have the potential for enhanced cutting.

Figure 8A:
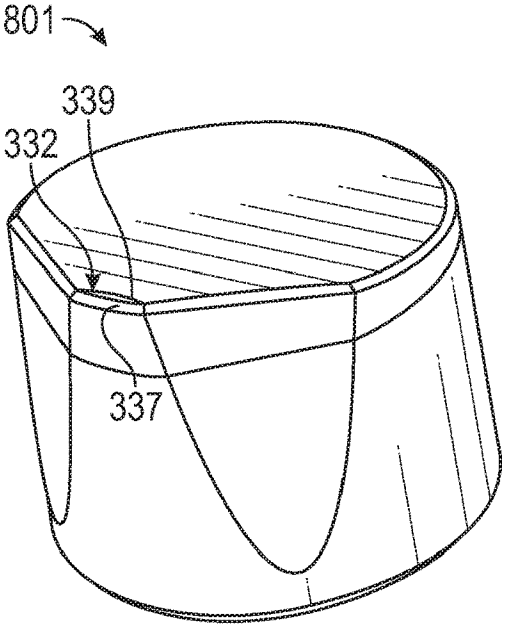
FIGS. 8A-8C are, respectively, perspective, front, and side views of another of the cutting elements suitable for use in the drill bit of FIGS. 2A-2B.
Figure 8B:
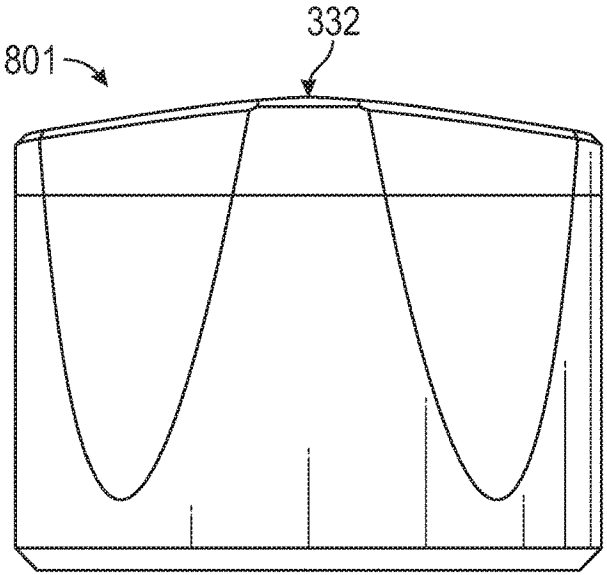
Figure 8C:
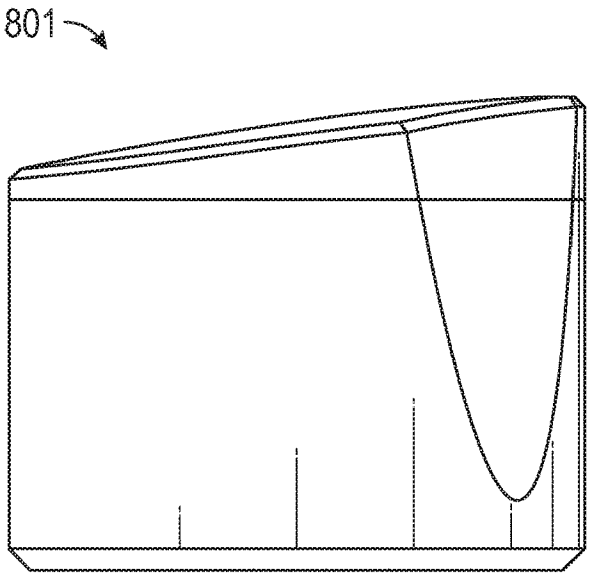

Another cutting element 801 suitable for use in the drill bit shown in FIGS. 2A-2B is depicted in FIGS. 8A-8C. As best shown in FIG. 8A, the ridge 332 of cutting element 801 is substantially shorter than the ridges employed and described in previous embodiments. Nevertheless, ridge 332 of cutter 801 has a length that extends from the outermost end 337 to a curved central most end 339. Surrounding surface 332 falls away from the planar upper surface of ridge 332 and is continuously curved.

Figure 9A:
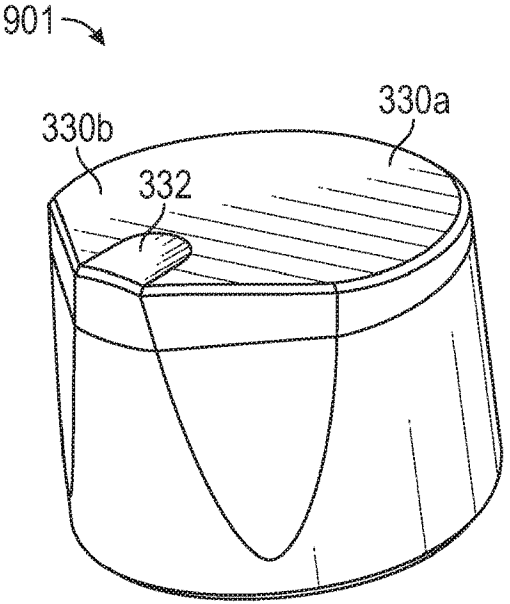
FIGS. 9A-9C are, respectively, perspective, front, and side views of another of the cutting elements suitable for use in the drill bit of FIGS. 2A-2B
Figure 9B:
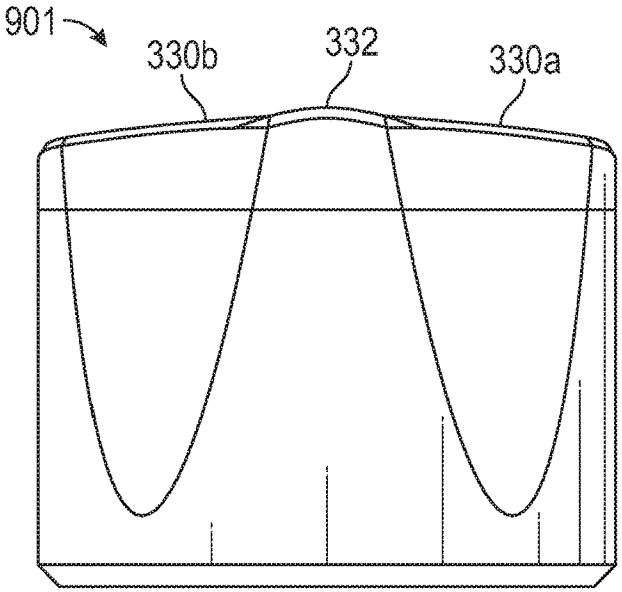
Figure 9C:
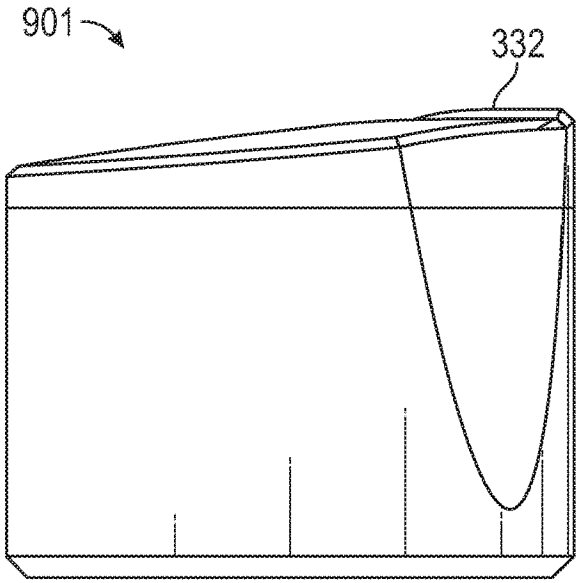

Another cutting element 901 suitable for use in the drill bit shown in FIGS. 2A-2B is depicted in FIGS. 9A-9C. In this embodiment, ridge 332 of cutting element 901 is not planar, but is convex or upwardly curved. As best shown in the front profile view of FIG. 9B, the upper surface of ridge 332 curves continuously between the intersection of ridge 332 with each side region 330*a,b*. This curvature is maintained along the entire length of the ridge 332 such that ridge 332 may be described as having a "speed bump" shape. The surrounding region 333 is continuously curved, and cutting element 901 may be formed with or without the facets 370. A cutter element having a ridge 332 that is upwardly convex as shown in FIGS. 9A-9C may also be employed with cutter elements previously described, such as cutter elements shown in FIGS. 4A-4B, in which the surrounding surface 333 was also convex in profile views.

The various cutting elements described herein may be manufactured by any desirable method. For example, the cutting elements may be manufactured by known pressing techniques, such as near net pressing, in which the entire cutting element, including the PCD cutting face, is formed into its final shape by pressing at high temperatures and pressures. In other instances, the cutting elements may be manufactured by first forming a cutting element having a PCD layer with a planar upper surface that extends perpendicular to the element's central axis 301. Thereafter, a ridge 332 of predetermined position, height, width and length is defined for the element. Next, a laser is employed to remove (ablate) portions of the PCD surface that do not includes the planar surface of the ridge, thereby forming the continuously curved surrounding surface 333.

While exemplary embodiments have been described above with reference to various depicted implementations and exploitations, it will be understood that these embodiments are illustrative only. Many variations, modifications, and additions to those described above are possible, such that the scope of the invention for which a patent is sought is not limited to those examples, and that, instead, the scope of the invention is to be determined from the literal and equivalent scope of the claims that follow.

What is claimed is:

1. A cutting element for a drill bit that is advanceable into a subterranean formation to form a borehole, the cutting element comprising:

a substrate portion having a diameter D and a central axis extending through the substrate portion, and a polycrystalline diamond (PCD) layer forming an end of the cutting element, the PCD layer comprising a cutting face bounded by a periphery;

wherein the cutting face comprises:

an elongate ridge having an upper surface defining the uppermost height of the cutting element and having a length that is less than diameter D, the ridge having a first ridge end and extending from the first ridge end in a direction towards the center of the cutting face and terminating in a second ridge end that is curved and spaced from the periphery; and a surrounding surface consisting of the entire cutting face except for the ridge, the surrounding surface being continuously curved along a curved path extending at least partially about the curved second ridge end.

2. The cutting element of claim 1 wherein the cutting element further comprises a leading edge at the intersection of the cutting face and the periphery, and wherein the first ridge end offset a distance from the leading edge.

3. The cutting element of claim 1 wherein the cutting face further comprises a pair of linear edges and a leading edge at the periphery, the leading edge being curved and positioned between the pair of linear edges.

4. The cutting element of claim 1 wherein the upper surface of the ridge is planar.

5. The cutting element of claim 4 further comprising a leading edge at the intersection of the cutting face with the periphery, and wherein the ridge extends from the second ridge end to the leading edge and the length of the ridge is less than 40% of the diameter of the cutting element.

6. The cutting element of claim 4 wherein the surrounding surface comprises;

a first side region on one side of the ridge and extending from the periphery to a first side of the ridge;

a second side region on the opposite side of the ridge from the first side region and extending from the periphery to a second side of the ridge that is opposite from the first side of the ridge;

a ramp region extending from the periphery to the second ridge end and extending between the first and second side regions; and wherein, in a profile view, a plane that encompasses the planar surface of the ridge forms a slant angle with the first side region and a ramp angle with the ramp region; and wherein the slant angle is different than the ramp angle, and wherein the thickness of the PCD layer varies along the periphery.

7. The cutting element of claim 6 wherein the slant angle is greater than the ramp angle and the thickness of the PCD layer is thicker in the ramp region than in the first side region.

8. The cutting element of claim 6 wherein the slant angle is between 2 and 20 degrees and the slant angle is greater than the ramp angle.

9. The cutting element of claim 1 wherein the upper surface of the ridge is convex.

10. The cutting element of claim 1 wherein the length of the ridge is less than 10% of the diameter of the cutting element.

11. The cutting element of claim 1 wherein the width of the ridge is less than 10% of the diameter of the cutting element.

12. The cutting element of claim 1 wherein the surrounding surface, in profile view, is linear from the ridge to the periphery at every location along the curved path.

13. The cutting element of claim 1 wherein the surrounding surface, in profile view, is curved from the ridge to the periphery at every location along the curved path.

14. The cutting element of claim 13 wherein the surrounding surface comprises;

a first side region on one side of the ridge and extending from the periphery to a first side of the ridge;

a second side region on the opposite side of the ridge from the first side region and extending from the periphery to a second side of the ridge that is opposite from the first side of the ridge;

a ramp region extending from the periphery to the second ridge end and extending between the first and second side regions; and wherein, in a profile view, each side region is curved having a radius of curvature R1 and the ramp region is curved having a radius of curvature R2 and wherein R1 is the same as R2.

15. The cutting element of claim 14 wherein the first side region, the second side region, and the ramp region, in profile view, are convex from the from the ridge to the periphery at every location along the curved path.

16. The cutting element of claim 1 wherein the thickness of the PCD layer varies along the periphery.

17. The cutting element of claim 16 wherein the periphery includes a leading point and a trailing point opposite the leading point, and wherein the thickness of the PCD layer at the trailing point is greater than the thickness of the PCD layer at a point 90 degrees from the trailing point.

18. The cutting element of claim 1 wherein the width of the ridge is non-uniform along its length.

19. A cutting element for a drill bit that is advanceable into a subterranean formation to form a borehole, the cutting element comprising:

a generally cylindrically shaped substrate formed about a central axis and having a diameter D and a polycrystalline diamond (PCD) layer attached to the substrate, the PCD layer comprising a cutting face with center C that is bounded by a periphery, the cutting face consisting of an elongate ridge and a continuously curved surrounding surface;

wherein the ridge includes a planar upper surface extending radially from a first ridge end that is adjacent to the periphery to a second ridge end disposed at a location that is offset a radial distance from the center C; and wherein the surrounding surface comprises a pair of side regions separated by the ramp region disposed between the side regions, wherein the pair of side regions, the ramp region and the intersection between the ramp region and each side region are all continuously curved; and wherein the highest point on the cutting face lies within the planar upper surface of the ridge.

20. The cutting element of claim 19 wherein each side region and the ramp region, in profile view, is linear from the planar surface of the ridge to the cutting face periphery at every location.

21. The cutting element of claim 20 wherein, in a profile view, a plane that encompasses the planar surface of the ridge forms a slant angle with each side region that is between 2 and 20 degrees.

22. The cutting element of claim 20 wherein, in a profile view, a plane that encompasses the planar surface of the ridge forms a ramp angle with the ramp region that is between 2 and 10 degrees.

23. The cutting element of claim 19 wherein, in a profile view, a plane that encompasses the planar surface of the ridge forms a slant angle with each side region and forms a ramp angle with the ramp region, and wherein the slant angle is different than the ramp angle.

24. The cutting element of claim 19 wherein the thickness of the PCD layer varies along the periphery.

25. The cutting element of claim 24 wherein the end of the planar upper surface of the ridge that is closest to the central axis is curved.

26. A drill bit advanceable into a subterranean formation to form a wellbore, the drill bit comprising:

a bit body; and at least one cutting element of claim 19 mounted in the bit body.

* * * * *